US012281392B2

(12) United States Patent
Yokoyama et al.

(10) Patent No.: US 12,281,392 B2
(45) Date of Patent: Apr. 22, 2025

(54) HOT DIP GALVANIZED STEEL SHEET AND METHOD FOR PRODUCING SAME

(71) Applicant: NIPPON STEEL CORPORATION, Tokyo (JP)

(72) Inventors: Takafumi Yokoyama, Tokyo (JP); Hiroyuki Kawata, Tokyo (JP); Kunio Hayashi, Tokyo (JP); Yuji Yamaguchi, Tokyo (JP); Satoshi Uchida, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 881 days.

(21) Appl. No.: 17/427,680

(22) PCT Filed: Feb. 6, 2020

(86) PCT No.: PCT/JP2020/004638
§ 371 (c)(1),
(2) Date: Aug. 2, 2021

(87) PCT Pub. No.: WO2020/162560
PCT Pub. Date: Aug. 13, 2020

(65) Prior Publication Data

US 2022/0127709 A1 Apr. 28, 2022

(30) Foreign Application Priority Data

Feb. 6, 2019 (JP) ..... 2019-020090

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/60*** | (2006.01) |
| ***C23C 2/02*** | (2006.01) |
| ***C23C 2/06*** | (2006.01) |
| ***C23C 2/28*** | (2006.01) |
| ***C23C 2/40*** | (2006.01) |

(52) U.S. Cl.

CPC ..... *C23C 2/40* (2013.01); *C21D 8/0226* (2013.01); *C21D 8/0263* (2013.01); *C21D 9/46* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/60* (2013.01); *C23C 2/02* (2013.01); *C23C 2/0224* (2022.08); *C23C 2/024* (2022.08); *C23C 2/06* (2013.01); *C23C 2/28* (2013.01); *C23C 2/29* (2022.08); *C21D 2211/001* (2013.01); *C21D 2211/002* (2013.01); *C21D 2211/003* (2013.01); *C21D 2211/005* (2013.01); *C21D 2211/008* (2013.01); *C21D 2211/009* (2013.01)

(58) Field of Classification Search

CPC ..... C21D 9/46

See application file for complete search history.

(56) References Cited

U.S. PATENT DOCUMENTS

| | | | | |
|---|---|---|---|---|
| 2008/0000555 | A1 | 1/2008 | Nonaka et al. | |
| 2013/0133786 | A1 | 6/2013 | Matsuda et al. | |
| 2014/0227555 | A1 | 8/2014 | Kawata et al. | |
| 2014/0242416 | A1 | 8/2014 | Matsuda et al. | |
| 2014/0370329 | A1 | 12/2014 | Nonaka et al. | |
| 2015/0083278 | A1 | 3/2015 | Kawata et al. | |
| 2015/0203947 | A1 | 7/2015 | Hasegawa et al. | |
| 2018/0002800 | A1 | 1/2018 | Hasegawa et al. | |
| 2018/0010207 | A1 | 1/2018 | Futamura et al. | |
| 2018/0030564 | A1 | 2/2018 | Hasegawa et al. | |
| 2018/0105908 | A1 | 4/2018 | Hayashi et al. | |
| 2020/0087764 | A1* | 3/2020 | Sano | C22C 38/58 |
| 2021/0207234 | A1 | 7/2021 | Takashima et al. | |
| 2023/0021370 | A1* | 1/2023 | Kohtake | C22C 38/60 |

FOREIGN PATENT DOCUMENTS

| | | | |
|---|---|---|---|
| CN | 103842542 | A | 6/2014 |
| JP | 2008-104532 | A | 4/2006 |

(Continued)

*Primary Examiner* — Jophy S. Koshy

(74) *Attorney, Agent, or Firm* — Birch, Stewart, Kolasch & Birch, LLP

(57) ABSTRACT

Provided are a hot dip galvanized steel sheet comprising a base steel sheet wherein the base steel sheet has a predetermined chemical composition, and contains ferrite: 50% or less, retained austenite: 30% or less, tempered martensite: 5% or more, fresh martensite: 10% or less, and pearlite and cementite in total: 5% or less, remaining structures consist of bainite, and a number ratio of tempered martensite with a Mn concentration profile satisfying $[Mn]_b/[Mn]_a>1.2$ and $[Mn]_a/[Mn]<2.0$ ([Mn] is the Mn content in the base steel sheet, $[Mn]_a$ is the average Mn concentration in the tempered martensite, and $[Mn]_b$ is the Mn concentration at the interfaces of different phases of the tempered martensite and ferrite phase and bainite phase) is 0.2 or more with respect to the total number of tempered martensite, and a method for producing the same.

3 Claims, 2 Drawing Sheets

(56) References Cited

FOREIGN PATENT DOCUMENTS

| | | | | |
|---|---|---|---|---|
| JP | 2011-184757 | A | 9/2011 | |
| JP | 2013-144830 | A | 7/2013 | |
| JP | 2017-48412 | A | 3/2017 | |
| WO | WO 2013/051238 | A1 | 4/2013 | |
| WO | WO 2014/020640 | A1 | 2/2014 | |
| WO | WO 2016/111273 | A1 | 7/2016 | |
| WO | WO 2016/113788 | A1 | 7/2016 | |
| WO | WO 2018/113789 | A | 7/2016 | |
| WO | WO 2016/171237 | A1 | 10/2016 | |
| WO | WO 2017/179372 | A1 | 10/2017 | |
| WO | WO-2018105003 | A1 * | 6/2018 | ..... C21D 9/46 |

* cited by examiner

HOT DIP GALVANIZED STEEL SHEET AND METHOD FOR PRODUCING SAME

FIELD

The present invention relates to a hot dip galvanized steel sheet and a method for producing the same, mainly relates to a high strength hot dip galvanized steel sheet to be worked into various shapes by press forming etc., as a steel sheet for automobile use and a method for producing the same.

BACKGROUND

In recent years, improvement of the fuel efficiency of automobiles has been sought from the viewpoint of control of hot house gas emissions accompanying the campaign against global warming. Application of high strength steel sheet for lightening the weight of car bodies and securing collision safety has been increasingly expanding. In particular, recently, the need for ultrahigh strength steel sheet with a tensile strength of 980 MPa or more has been increasingly rising. Further, high strength hot dip galvanized steel sheet which is hot dip galvanized on its surface is being sought for portions in car bodies where rust prevention is demanded.

Hot dip galvanized steel sheet used for auto parts requires not only strength, but also press formability, weldability, and various other types of workability necessary for forming parts. Specifically, from the viewpoint of press formability, excellent elongation (total elongation in tensile test: El) and stretch flangeability (hole expansion rate: X) are required from steel sheet. Furthermore, if considering application of high strength steel sheet to automobiles used in cold regions, it is required that the high strength steel sheet not fracture brittlely in a low temperature environment, i.e., that it has an excellent low temperature toughness.

In general, press formability deteriorates along with the higher strength of steel sheet. As means for achieving both higher strength and press formability of steel, TRIP (transformation induced plasticity) steel sheet utilizing transformation induced plasticity of retained austenite is known.

PTLs 1 to 3 disclose art relating to high strength TRIP steel sheet controlled in fractions of structural constituents to predetermined ranges and improved in elongation and hole expansion rates. Further, PTL 4 describes high strength steel sheet having a predetermined chemical composition, and including, in terms of volume fraction, 15% or less of ferrite having an average crystal grain diameter of 2 μm or less, 2 to 15% of retained austenite having an average crystal grain diameter of 2 μm or less, 10% or less of martensite having an average crystal grain diameter of 3 μm or less, and a balance of bainite and tempered martensite having an average crystal grain diameter of 6 μm or less, wherein the average number of cementite grains having a grain diameter of 0.04 μm or more existing in the bainite and tempered martensite grains is 10 or more, and describes that this high strength steel sheet has a tensile strength of 1180 MPa or more and has a high elongation and hole expandability and excellent bending workability accompanying the same.

Furthermore, TRIP type high strength hot dip galvanized steel sheet is disclosed in several literature.

Normally, to produce hot dip galvanized steel sheet in a continuous annealing furnace, it is necessary to heat the steel sheet to the reverse transformation temperature region (>Ac1) and soak it, then in the middle of the process for cooling down to room temperature, dip it in a 460° C. or so hot dip galvanizing bath. Alternatively, after heating and soaking, then cooling down to room temperature, it is necessary to again heat the steel sheet to the hot dip galvanizing bath temperature and dip it in the bath. Furthermore, usually, to produce hot dip galvannealed steel sheet, it is necessary to perform alloying treatment after dipping the steel sheet in the coating bath, then reheat the steel sheet to a 460° C. or more temperature region. For example, PTL 5 describes that the steel sheet is heated to Ac1 or more, is then rapidly cooled down to the martensite transformation start temperature (Ms) or less, is then reheated to the bainite transformation temperature region and held at the temperature region to stabilize the austenite (austemper it), and is then reheated to the coating bath temperature or alloying treatment temperature for galvannealing. However, with such a production method, since the martensite and bainite is excessively tempered in the coating and alloying step, there was the problem that the material quality became poor.

PTLs 6 to 10 disclose a method for producing hot dip galvanized steel sheet comprising cooling the steel sheet after coating and alloying treatment, then reheating it to temper the martensite.

CITATIONS LIST

Patent Literature

[PTL 1] WO 2013/051238
[PTL 2] Japanese Unexamined Patent Publication No. 2006-104532
[PTL 3] Japanese Unexamined Patent Publication No. 2011-184757
[PTL 4] WO 2017/179372
[PTL 5] WO 2014/020640
[PTL 6] Japanese Unexamined Patent Publication No. 2013-144830
[PTL 7] WO 2016/113789
[PTL 8] WO 2016/113788
[PTL 9] WO 2016/171237
[PTL 10] Japanese Unexamined Patent Publication No. 2017-48412

SUMMARY

Technical Problem

On the other hand, hot dip galvanized steel sheet used for automobiles used in cold regions is required to not only possess press formability, but also not fracture in a brittle manner in a low temperature environment. However, in the prior art, no sufficient study has necessarily been made from the two viewpoints of the improvement of the press formability and the improvement of such low temperature toughness. For this reason, there is still room for improvement of the properties of hot dip galvanized steel sheet, in particular hot dip galvanized steel sheet used for members for automobiles.

Therefore, an object of the present invention is to provide hot dip galvanized steel sheet excellent in press formability and low temperature toughness and having a tensile strength of 980 MPa or more and a method for producing the same.

Solution to Problem

The inventors engaged in intensive studies for solving this problem and as a result obtained the following findings:

(i) In the continuous hot dip galvanization heat treatment step, martensite is formed by cooling down to the Ms or less after coating or coating and alloying. Further, after that, the steel may be reheated and held isothermally to suitably temper the martensite and, in the case of steel sheet containing retained austenite, further stabilize the retained austenite. By such heat treatment, the martensite is no longer excessively tempered by the coating or coating and alloying, and therefore the balance of strength and ductility is improved.

(ii) Furthermore, the inventors discovered that if the Mn concentration at the interfaces of different phases comprised of tempered martensite and soft structures contacting the same (i.e., ferrite and bainite) is a certain value or more, the low temperature toughness is improved. The detailed mechanism is not clear, but in general it is believed that brittle fracture proceeds due to the formation and propagation of cleavage cracks by dislocations piled up (gathered) at the crystal grain boundaries and consequent concentration of stress at the grain boundaries. In composite structure steel, it is believed that the regions where dislocations collect and stress concentrates are the interfaces between different phases comprised of soft structures (ferrite and bainite) and hard structures (tempered martensite). If the Mn concentration at the interfaces of different phases is a certain value or more, it is believed that some sort of interaction occurs between the group of dislocations and Mn atoms deposited at the interfaces of the different phases and formation of cleavage cracks is suppressed. Further, the inventors discovered that the above Mn concentration profile is realized by isothermal holding in the 480 to 600° C. or so temperature region during a continuous hot dip galvanization heat treatment step. However, this isothermal holding has to be performed before the austenite transforms to martensite. Further, if performing this isothermal holding in this temperature region after coating, deterioration of the powdering property of the coating layer etc., is caused. Therefore, the isothermal holding has to be performed before the coating and alloying treatment.

(iii) Furthermore, the inventors discovered that the effect of the above (ii) becomes more remarkable by limitation of the casting conditions at the time of continuous casting. That is, they discovered that due to forming Mn segregated regions in advance at the time of casting, the Mn concentration at the regions of interfaces of different phases explained in (ii) increased. However, if making the Mn concentration excessively proceed, it was learned that the low temperature toughness deteriorates. This is believed to be because if the Mn concentration excessively proceeds, in the final structure, the Mn concentration increases not only at the regions of interfaces of different phases, but also inside the grains of the tempered martensite. It is believed that tempered martensite in which Mn is concentrated over the grain as a whole is poor in toughness.

The present invention was realized based on the above findings and specifically is as follows:

(1) A hot dip galvanized steel sheet comprising a base steel sheet and a hot dip galvanized layer on at least one surface of the base steel sheet, wherein the base steel sheet has a chemical composition comprising, by mass %, C: 0.050% to 0.350%,
Si: 0.10% to 2.50%,
Mn: 1.00% to 3.50%,
P: 0.050% or less,
S: 0.0100% or less,
Al: 0.001% to 1.500%,
N: 0.0100% or less,
O: 0.0100% or less,
Ti: 0% to 0.200%,
B: 0% to 0.0100%,
V: 0% to 1.00%,
Nb: 0% to 0.100%,
Cr: 0% to 2.00%,
Ni: 0% to 1.00%,
Cu: 0% to 1.00%,
Co: 0% to 1.00%,
Mo: 0% to 1.00%,
W: 0% to 1.00%,
Sn: 0% to 1.00%,
Sb: 0% to 1.00%,
Ca: 0% to 0.0100%,
Mg: 0% to 0.0100%,
Ce: 0% to 0.0100%,
Zr: 0% to 0.0100%,
La: 0% to 0.0100%,
Hf: 0% to 0.0100%,
Bi: 0% to 0.0100%,
REM other than Ce and La: 0% to 0.0100% and
a balance of Fe and impurities, a steel microstructure at a range of ⅛ thickness to ⅜ thickness centered about a position of ¼ thickness from a surface of the base steel sheet contains, by volume fraction, ferrite: 0% to 50%,
retained austenite: 0% to 30%,
tempered martensite: 5% or more,
fresh martensite: 0% to 10%, and
pearlite and cementite in total: 0% to 5%, when there are remaining structures, the remaining structures consist of bainite, and a number ratio of tempered martensite with a Mn concentration profile satisfying the following formulas (1) and (2) is 0.2 or more with respect to the total number of the tempered martensite:

$$[Mn]_b/[Mn]_a>1.2 \quad (1)$$

$$[Mn]_a/[Mn]<2.0 \quad (2)$$

where [Mn] is the Mn content (mass %) in the base steel sheet, $[Mn]_a$ is the average Mn concentration (mass %) in the tempered martensite, and $[Mn]_b$ is the Mn concentration (mass %) at the interfaces of different phases of the tempered martensite and ferrite phase and bainite phase.

(2) The hot dip galvanized steel sheet according to (1), wherein the steel microstructure further contains, by volume fraction, retained austenite: 6% to 30%.

(3) A method for producing the hot dip galvanized steel sheet according to the above (1) or (2), comprising a continuous casting step for continuously casting a slab having the chemical composition according to the above (1), a hot rolling step for hot rolling the cast slab, and a hot dip galvanizing step for hot dip galvanizing the obtained steel sheet, wherein (A) the continuous casting step satisfies the conditions of the following (A1) and (A2):

(A1) a slab surface temperature at the time of the end of a secondary cooling is 500 to 1100° C. and (A2) a casting rate is 0.4 to 3.0 m/min, and (B) the hot dip galvanizing step comprises heating the steel sheet to first soak it, first cooling then second soaking the first soaked steel sheet, dipping the second soaked steel sheet in a hot dip galvanizing bath, second cooling the coated steel sheet, and heating the second cooled steel sheet then third soaking it, and further satisfies the conditions of the following (B1) to (B6):

(B1) in the heating of the steel sheet before the first soaking, the average heating rate from 650° C. to a maximum heating temperature of Ac1+30° C. or more and 950° C. or less is 0.5° C./s to 10.0° C./s, (B2) the steel sheet is held at the maximum heating temperature for 1 second to 1000 seconds (first soaking), (B3) an average cooling rate in a temperature range of 700 to 600° C. at the first cooling is 10 to 100° C./s, (B4) the first cooled steel sheet is held in a range of 480 to 600° C. for 80 seconds to 500 seconds (second soaking), (B5) the second cooling is performed down to Ms−50° C. or less, and (B6) the second cooled steel sheet is heated to a temperature region of 200 to 420° C., then held in the temperature region for 5 to 500 seconds (third soaking).

Advantageous Effects of Invention

According to the present invention, it is possible to obtain hot dip galvanized steel sheet excellent in press formability, specifically ductility and hole expandability and further low temperature toughness.

DESCRIPTION OF EMBODIMENTS

<Hot Dip Galvanized Steel Sheet>

Figure 1:
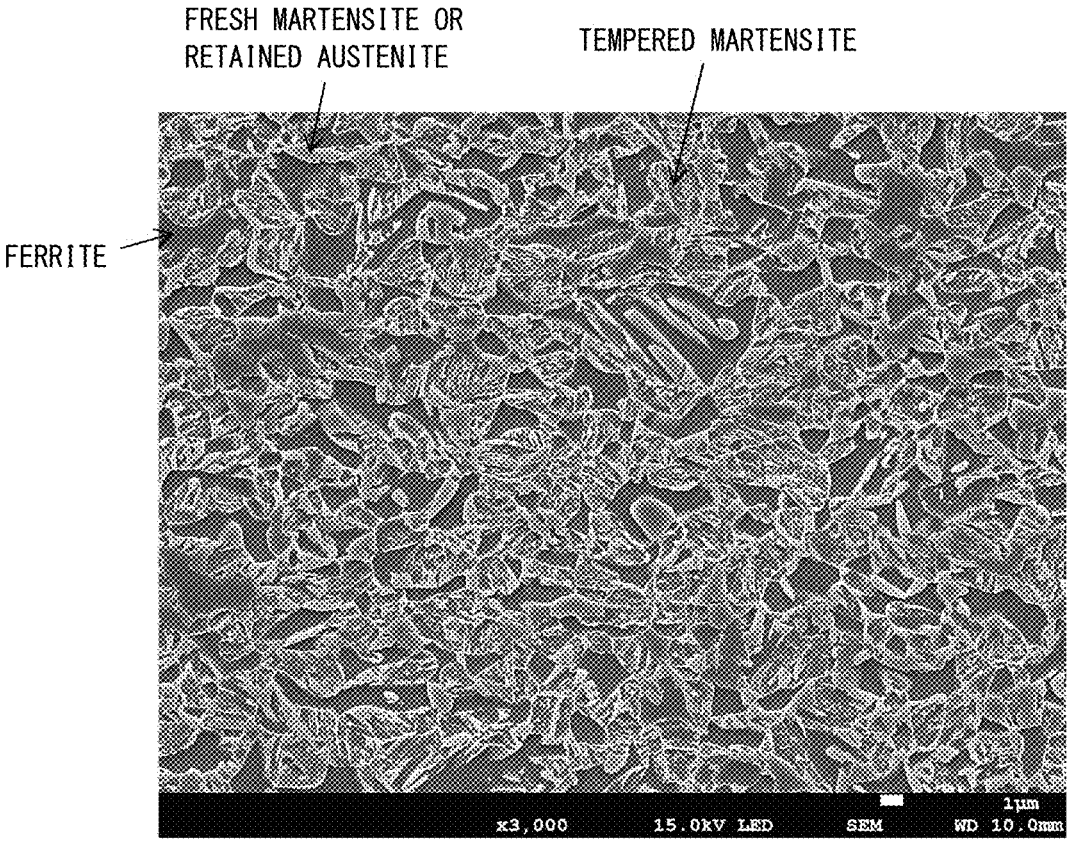
FIG. 1 shows a reference view of an SEM secondary electron image.

The hot dip galvanized steel sheet according to the embodiment of the present invention comprises a base steel sheet and a hot dip galvanized layer on at least one surface of the base steel sheet, wherein the base steel sheet has a chemical composition comprising, by mass %, C: 0.050% to 0.350%,
Si: 0.10% to 2.50%,
Mn: 1.00% to 3.50%,
P: 0.050% or less,
S: 0.0100% or less,
Al: 0.001% to 1.500%,
N: 0.0100% or less,
O: 0.0100% or less,
Ti: 0% to 0.200%,
B: 0% to 0.0100%,
V: 0% to 1.00%,
Nb: 0% to 0.100%,
Cr: 0% to 2.00%,
Ni: 0% to 1.00%,
Cu: 0% to 1.00%,
Co: 0% to 1.00%,
Mo: 0% to 1.00%,
W: 0% to 1.00%,
Sn: 0% to 1.00%,
Sb: 0% to 1.00%,
Ca: 0% to 0.0100%,
Mg: 0% to 0.0100%,
Ce: 0% to 0.0100%,
Zr: 0% to 0.0100%,
La: 0% to 0.0100%,
Hf: 0% to 0.0100%,
Bi: 0% to 0.0100%,
REM other than Ce and La: 0% to 0.0100% and
a balance of Fe and impurities, a steel microstructure at a range of ⅛ thickness to ⅜ thickness centered about a position of ¼ thickness from a surface of the base steel sheet contains, by volume fraction,
ferrite: 0% to 50%,
retained austenite: 0% to 30%,
tempered martensite: 5% or more,
fresh martensite: 0% to 10%, and
pearlite and cementite in total: 0% to 5%, when there are remaining structures, the remaining structures consist of bainite, and a number ratio of tempered martensite with a Mn concentration profile satisfying the following formulas (1) and (2) is 0.2 or more with respect to the total number of the tempered martensite:

$$[Mn]_b/[Mn]_a>1.2 \quad (1)$$

$$[Mn]_a/[Mn]<2.0 \quad (2)$$

where [Mn] is the Mn content (mass %) in the base steel sheet, $[Mn]_a$ is the average Mn concentration (mass %) in the tempered martensite, and $[Mn]_b$ is the Mn concentration (mass %) at the interfaces of different phases of the tempered martensite and ferrite phase and bainite phase.

[Chemical Composition]

First, the reasons for limitation of the chemical composition of the base steel sheet according to the embodiment of the present invention (below, also simply referred to as the "steel sheet") as described above will be explained. In this Description, the "%" used in prescribing the chemical composition are all "mass %" unless otherwise indicated. Further, in this Description, "to" when showing the ranges of numerical values unless otherwise indicated will be used in the sense including the lower limit values and upper limit values of the numerical values described before and after it.

[C: 0.050% to 0.350%]

C is an element essential for securing the steel sheet strength. If less than 0.050%, the required high strength cannot be obtained, and therefore the content of C is 0.050% or more. The content of C may be 0.070% or more, 0.080% or more, 0.100% or more as well. On the other hand, if more than 0.350%, the workability or weldability falls, and therefore the content of C is 0.350% or less. The content of C may be 0.340% or less, 0.320% or less, or 0.300% or less as well.

[Si: 0.10% to 2.50%]

Si is an element suppressing formation of iron carbides and contributing to improvement of strength and shapeability, but excessive addition causes the weldability of the steel sheet to deteriorate. Therefore, the content is 0.10 to 2.50%. The content of Si may be 0.20% or more, 0.30% or more, 0.40% or more, or 0.50% or more as well and/or may be 2.20% or less, 2.00% or less, or 1.90% or less as well.

[Mn: 1.00% to 3.50%]

Mn (manganese) is a powerful austenite stabilizing element and an element effective for increasing the strength of the steel sheet. Excessive addition causes the weldability or low temperature toughness to deteriorate. Therefore, the content is 1.00 to 3.50%. The content of Mn may be 1.10% or more, 1.30% or more, or 1.50% or more as well and/or may be 3.30% or less, 3.10% or less, or 3.00% or less as well.

[P: 0.050% or Less]

P (phosphorus) is a solution strengthening element and an element effective for increasing the strength of the steel sheet. Excessive addition causes the weldability and toughness to deteriorate. Therefore, the content of P is limited to 0.050% or less. Preferably it is 0.045% or less, 0.035% or less, or 0.020% or less. However, since extreme reduction of the content of P would result in high dephosphorizing costs, from the viewpoint of economics, a lower limit of 0.001% is preferable.

[S: 0.0100% or Less]

S (sulfur) is an element contained as an impurity and forms MnS in steel to cause the toughness and hole expandability to deteriorate. Therefore, the content of S is restricted to 0.0100% or less as a range where the toughness and hole expandability do not remarkably deteriorate. Preferably it is 0.0050% or less, 0.0040% or less, or 0.0030% or less. However, since extreme reduction of the content of S would result in high desulfurizing costs, from the viewpoint of economics, a lower limit of 0.0001% is preferable.

[Al: 0.001% to 1.500%]

Al (aluminum) is added in at least 0.001% for deoxidation of the steel. However, even if excessively adding it, not only does the effect become saturated and is a rise in cost invited, but also the transformation temperature of the steel is raised and the load at the time of hot rolling is increased. Therefore, an amount of Al of 1.500% is the upper limit. Preferably it is 1.200% or less, 1.000% or less, or 0.800% or less.

[N: 0.0100% or Less]

N (nitrogen) is an element contained as an impurity. If its content is more than 0.0100%, it forms coarse nitrides in the steel and causes deterioration of the bendability and hole expandability. Therefore, the content of N is limited to 0.0100% or less. Preferably it is 0.0080% or less, 0.0060% or less, or 0.0050% or less. However, since extreme reduction of the content of N would result in high denitriding costs, from the viewpoint of economics, a lower limit of 0.0001% is preferable.

[O: 0.0100% or Less]

O (oxygen) is an element contained as an impurity. If its content is more than 0.0100%, it forms coarse oxides in the steel and causes deterioration of the bendability and hole expandability. Therefore, the content of O is limited to 0.0100% or less. Preferably it is 0.0080% or less, 0.0060% or less, or 0.0050% or less. However, from the viewpoint of the producing costs, a lower limit of 0.0001% is preferable.

The basic chemical composition of the base steel sheet according to the embodiment of the present invention is as explained above. The base steel sheet may however further contain the following elements according to need.

[Ti: 0% to 0.200%, V: 0% to 1.00%, Nb: 0% to 0.100%, Cr: 0% to 2.00%, Ni: 0% to 1.00%, Cu: 0% to 1.00%, Co: 0% to 1.00%, Mo: 0% to 1.00%, B: 0% to 0.0100%, W: 0% to 1.00%, Sn: 0% to 1.00%, and Sb: 0% to 1.00%]

Ti (titanium), V (vanadium), Nb (niobium), Cr (chromium), Ni (nickel), Cu (copper), Co (cobalt), Mo (molybdenum), B (boron), W (tungsten), Sn (tin), and Sb (antimony) are all elements effective for raising the strength of steel sheet. For this reason, one or more of these elements may be added in accordance with need. However, if excessively adding these elements, the effect becomes saturated and in particular an increase in cost is invited. Therefore, the contents are Ti: 0% to 0.200%, V: 0% to 1.00%, Nb: 0% to 0.100%, Cr: 0% to 2.00%, Ni: 0% to 1.00%, Cu: 0% to 1.00%, Co: 0% to 1.00%, Mo: 0% to 1.00%, B: 0% to 0.0100%, W: 0% to 1.00%, Sn: 0% to 1.00%, Sb: 0% to 1.00%. The elements may also be 0.005% or more or 0.010% or more. In particular, the content of B may be 0.0001% or more or 0.0005% or more.

[Ca: 0% to 0.0100%, Mg: 0% to 0.0100%, Ce: 0% to 0.0100%, Zr: 0% to 0.0100%, La: 0% to 0.0100%, Hf: 0% to 0.0100%, Bi: 0% to 0.0100%, and REM Other than Ce and La: 0% to 0.0100%]

Ca (calcium), Mg (magnesium), Ce (cerium), Zr (zirconium), La (lanthanum), Hf (hafnium), and REM (rare earth elements) other than Ce and La are elements contributing to microdispersion of inclusions in the steel. Bi (bismuth) is an element lightening the microsegregation of Mn, Si, and other substitution type alloying elements in the steel. Since these respectively contribute to improvement of the workability of steel sheet, one or more of these elements may be added in accordance with need. However, excessive addition causes deterioration of the ductility. Therefore, a content of 0.0100% is the upper limit. Further, the elements may be 0.0005% or more or 0.0010% or more as well.

In the base steel sheet according to the embodiment of the present invention, the balance other than the above elements is comprised of Fe and impurities. "Impurities" are constituents entering due to various factors in the producing process, first and foremost the raw materials such as the ore and scrap, when industrially producing the base steel sheet and encompass all constituents not intentionally added to the base steel sheet according to the embodiment of the present invention. Further, "impurities" encompass all elements other than the constituents explained above contained in the base steel sheet in levels where the actions and effects distinctive to those elements do not affect the properties of the hot dip galvanized steel sheet according to the embodiment of the present invention.

[Steel Structures Inside Steel Sheet]

Next, the reasons for limitation of the internal structure of the base steel sheet according to the embodiment of the present invention will be explained.

[Ferrite: 0 to 50%]

Ferrite is a soft structure excellent in ductility. It may be included to improve the elongation of steel sheet in accordance with the demanded strength or ductility. However, if excessively contained, it becomes difficult to secure the desired steel sheet strength. Therefore, the content is a volume fraction of 50% as the upper limit and may be 45% or less, 40% or less, or 35% or less. The content of ferrite may be a volume fraction of 0%. For example, it may be 3% or more, 5% or more, or 10% or more.

[Tempered Martensite: 5% or More]

Tempered martensite is a high strength tough structure and is an essential metallic structure in the present invention. To balance the strength, ductility, and hole expandability at a high level, it is included in a volume fraction of at least 5% or more. Preferably, it is a volume fraction of 10% or more. It may be 15% or more or 20% or more as well. For example, the content of the tempered martensite may be a volume fraction of 90% or less, 85% or less, 80% or less, or 70% or less.

[Fresh Martensite: 0 to 10%]

In the present invention, fresh martensite means martensite which is not tempered, i.e., martensite not containing carbides. This fresh martensite is a brittle structure, so becomes a starting point of fracture at the time of plastic deformation and causes deterioration of the local ductility of the steel sheet. Therefore, the content is a volume fraction of 0 to 10%. More preferably it is 0 to 8% or 0 to 5%. The content of fresh martensite may be a volume fraction of 1% or more or 2% or more.

[Retained Austenite: 0% to 30%]

Retained austenite improves the ductility of steel sheet due to the TRIP effect of transformation into martensite due to work induced transformation during deformation of steel sheet. On the other hand, to obtain a large amount of retained austenite, C and other alloying elements must be included in large amounts. For this reason, the upper limit value of the retained austenite is a volume fraction of 30%. It may be 25% or less or 20% or less as well. However, if desiring to improve the ductility of the steel sheet, the content is preferably a volume fraction of 6% or more, 8% or more, or 10% or more. Further, if the content of the retained austenite is 6% or more, the content of Si in the base steel sheet is preferably, by mass %, 0.50% or more.

[Pearlite and Cementite in Total: 0 to 5%]

Pearlite includes hard coarse cementite and forms a starting point of fracture at the time of plastic deformation, so causes the local ductility of the steel sheet to deteriorate. Therefore, the content, together with the cementite, is a volume fraction of 0 to 5%. It may also be 0 to 3% or 0 to 2%.

The remaining structures besides the above structures may be 0%, but if there are any present, they are bainite. The remaining bainite structures may be upper bainite or lower bainite or may be mixed structures of the same.

[Number Ratio of Tempered Martensite with Mn Concentration Profile Satisfying Formulas (1) and (2) of 0.2 or More with Respect to Total Number of Tempered Martensite]

$$[Mn]_b/[Mn]_a>1.2 \quad (1)$$

$$[Mn]_a/[Mn]<2.0 \quad (2)$$

where [Mn] is the Mn content (mass %) in the base steel sheet, $[Mn]_a$ is the average Mn concentration (mass %) in the tempered martensite, and $[Mn]_b$ is the Mn concentration (mass %) at the interfaces of different phases of the tempered martensite and ferrite phase and bainite phase.

In the present invention, the above conditions have to be satisfied to obtain the desired low temperature toughness. To obtain the effect of raising the toughness by strengthening the interfaces of the different phases, $[Mn]_b/[Mn]_a$ must be over 1.2. On the other hand, if $[Mn]_a/[Mn]$ becomes 2.0 or more, the toughness of the tempered martensite itself deteriorates. If the number ratio of the tempered martensite simultaneously satisfying the above conditions becomes 0.2 or more with respect to the total number of tempered martensite, the low temperature toughness rises to the desired level. The number ratio of the tempered martensite may be 0.3 or more or 0.4 or more and/or may be 1.0 or less or 0.9 or less.

The fractions of the steel structures of the hot dip galvanized steel sheet are evaluated by the SEM-EBSD method (electron backscatter diffraction method) and SEM secondary electron image observation.

First, a sample is taken from the cross-section of thickness of the steel sheet parallel to the rolling direction so that the cross-section of thickness at the center position in the width direction becomes the observed surface. The observed surface is machine polished and finished to a mirror surface, then electrolytically polished. Next, in one or more observation fields at a range of ⅛ thickness to ⅜ thickness centered about ¼ thickness from the surface of the base steel sheet at the observed surface, a total area of $2.0\times10^{-9}$ $m^2$ or more is analyzed for crystal structures and orientations by the SEM-EBSD method. The data obtained by the EBSD method is analyzed using "OIM Analysis 6.0" made by TSL. Further, the distance between evaluation points (steps) is 0.03 to 0.20 μm. Regions judged to be FCC iron from the results of observation are deemed retained austenite. Further, boundaries with differences in crystal orientation of 15 degrees or more are deemed grain boundaries to obtain a crystal grain boundary map.

Next, the same sample as that observed by EBSD is corroded by Nital and observed by secondary electron image for the same fields as observation by EBSD. Since observing the same fields as the time of EBSD measurement, Vickers indents and other visual marks may be provided in advance. From the obtained secondary electron image, the area ratios of the ferrite, retained austenite, bainite, tempered martensite, fresh martensite, and pearlite are respectively measured and the results deemed the volume fractions. Regions having lower structures in the grains and having several variants of cementite, more specifically two or more variants, precipitating are judged to be tempered martensite (for example, see reference drawing of FIG. 1). Regions where cementite precipitates in lamellar form are judged to be pearlite (or pearlite and cementite in total). Regions which are small in brightness and in which no lower structures are observed are judged to be ferrite (for example, see reference drawing of FIG. 1). Regions which are large in brightness and in which lower structures are not revealed by etching are judged to be fresh martensite and retained austenite (for example, see reference drawing of FIG. 1). Regions not corresponding to any of the above regions are judged to be bainite. The volume ratios of the same are calculated by the point counting method and used as the volume ratios of the structures. The volume ratio of the fresh martensite can be found by subtracting the volume ratio of retained austenite found by X-ray diffraction.

The volume ratio of retained austenite is measured by the X-ray diffraction method. At a range of ⅛ thickness to ⅜ thickness centered about ¼ thickness from the surface of the base steel sheet, a surface parallel to the sheet surface is polished to a mirror finish and measured for area ratio of FCC iron by the X-ray diffraction method. This is used as the volume fraction of the retained austenite.

In the present invention, the Mn concentration at the interfaces of the different phases of tempered martensite and ferrite and bainite is found by the STEM-EELS method. Specifically, for example, it is found by the method disclosed in METALLURGICAL AND MATERIALS TRANSACTIONS A: vol. 45A, p. 1877 to 1888. First, a sample is taken from the cross-section of thickness of the steel sheet parallel to the rolling direction so that the cross-section of thickness at the center position in the width direction becomes the observed surface. The observed surface is machine polished and finished to a mirror surface, then electrolytically polished. Next, in one or more observation fields at a range of ⅛ thickness to ⅜ thickness centered about ¼ thickness from the surface of the base steel sheet at the observed surface, a total area of $2.0\times10^{-9}$ $m^2$ or more is analyzed for crystal structures and orientations by the SEM-EBSD method to identify the tempered martensite and ferrite and bainite. Next, the region including the interfaces of the different phases is extracted by FIB in the SEM. After that, Ar ion milling etc., is used to reduce the thickness down to about 70 nm. The electron energy loss spectrum (EELS) is obtained along a line traversing the interfaces of the different phases by aberration spectrum STEM from the test piece reduced in thickness. The above measurement is performed for the individual interfaces for at least five or more, preferably 10 or more samples of the tempered martensite. The maximum value of the Mn concentration in the Mn concentration profile measured traversing the interfaces of the different phases is $[Mn]_b$. The value obtained by averaging the Mn concentration profile at the tempered martensite side leaving aside the regions of interfaces of different phases is $[Mn]_a$. [Mn] is the same as the Mn content in the steel composition. The scan steps at the time of line analysis is preferably 0.1 nm or so. In the present invention, for example, if measuring 10 different tempered martensite, if the number of tempered martensite satisfying the following formulas (1) and (2) is two or more, it is judged if the number ratio of the tempered martensite where the Mn concentration profile satisfying the formulas (1) and (2) is 0.2 or more with respect to the total number of tempered martensite:

$$[Mn]_b/[Mn]_a>1.2 \quad (1)$$

$$[Mn]_a/[Mn]<2.0 \quad (2)$$

(Hot Dip Galvanized Layer)

The base steel sheet according to the embodiment of the present invention has a hot dip galvanized layer on at least one surface, preferably on both surfaces. This coating layer may be a hot dip galvanized layer or hot dip galvannealed layer having any composition known to persons skilled in the art and may include Al and other additive elements in addition to Zn. Further, the amount of deposition of the coating layer is not particularly limited and may be a general amount of deposition.

<Method for Manufacturing Hot Dip Galvanized Steel Sheet>

Next, the method for producing the hot dip galvanized steel sheet according to the embodiment of the present invention will be explained. The following explanation is meant to illustrate the characteristic method for producing the hot dip galvanized steel sheet according to the embodiment of the present invention and is not meant to limit the hot dip galvanized steel sheet to one produced by the production method explained below.

The method for producing the hot dip galvanized steel sheet comprises a continuous casting step for continuously casting a slab having the same chemical composition as the chemical composition explained above relating to the base steel sheet, a hot rolling step for hot rolling the cast slab, and a hot dip galvanizing step for hot dip galvanizing the obtained steel sheet, wherein (A) the continuous casting step satisfies the conditions of the following (A1) and (A2):

(A1) a slab surface temperature at the time of the end of a secondary cooling is 500 to 1100° C. and (A2) a casting rate is 0.4 to 3.0 m/min, and (B) the hot dip galvanizing step comprises heating the steel sheet to first soak it, first cooling then second soaking the first soaked steel sheet, dipping the second soaked steel sheet in a hot dip galvanizing bath, second cooling the coated steel sheet, and heating the second cooled steel sheet then third soaking it, and further satisfies the conditions of the following (B1) to (B6):

(B1) in the heating of the steel sheet before the first soaking, the average heating rate from 650° C. to a maximum heating temperature of Ac1+30° C. or more and 950° C. or less is 0.5° C./s to 10.0° C./s, (B2) the steel sheet is held at the maximum heating temperature for 1 second to 1000 seconds (first soaking), (B3) an average cooling rate in a temperature range of 700 to 600° C. at the first cooling is 10 to 100° C./s, (B4) the first cooled steel sheet is held in a range of 480 to 600° C. for 80 seconds to 500 seconds (second soaking), (B5) the second cooling is performed down to Ms−50° C. or less, and (B6) the second cooled steel sheet is heated to a temperature region of 200 to 420° C., then held in the temperature region for 5 to 500 seconds (third soaking).

Below, the method for producing the hot dip galvanized steel sheet will be explained in detail.

[(A) Continuous Casting Step]

[Slab Surface Temperature at Time of End of Secondary Cooling: 500 to 1100° C. and Casting Rate: 0.4 to 3.0 m/min]

The steel slab used in the present invention is cast by the continuous casting method. The thickness of the slab is generally 200 to 300 mm, for example, is 250 mm. If the slab surface temperature at the time of end of the secondary cooling by water at the time of continuous casting (time of end of cooling at secondary cooling zone at casting exit side) rises above 1100° C. or the casting rate falls below 0.4 m/min, the degree of segregation of Mn excessively rises and $[Mn]_a/[Mn]$ tends to become 2.0 or more. On the other hand, if the slab surface temperature falls below 500° C. or the casting speed rises above 3.0 m/min, the degree of Mn segregation becomes insufficient, so $[Mn]b/[Mn]_a$ tends to become 1.2 or less. The slab surface temperature at the time of end of the secondary cooling may be 600° C. or more or 700° C. or more and/or may be 1050° C. or less. Further, the casting rate may be 0.6 m/min or more or 0.8 m/min or more and/or may be 2.5 m/min or less or 2.0 m/min or less. The slab surface temperature is measured by a radiation thermometer.

[Hot Rolling Step]

In this method, the hot rolling step is not particularly limited and can be performed under any suitable conditions. Therefore, the following explanation relating to the hot rolling step is intended as a simple illustration and is not intended as limiting the hot rolling step in the present method to one performed under the specific conditions as explained below.

First, in the hot rolling step, a slab having the same chemical composition as the chemical composition explained above relating to the base steel sheet is heated before hot rolling. The heating temperature of the slab is not particularly limited, but for sufficient dissolution of the borides, carbides, etc., generally 1150° C. or more is preferable.

[Rough Rolling]

In this method, for example, the heated slab may be rough rolled before the finish rolling so as to adjust the sheet thickness etc. Such rough rolling is not particularly limited, it is preferable to perform it to give a total rolling reduction at 1050° C. or more of 60% or more. If the total rolling reduction is less than 60%, since the recrystallization during hot rolling becomes insufficient, sometimes this leads to unevenness of the structure of the hot rolled sheet. The above total rolling reduction may, for example, be 90% or less.

[Finish Rolling Inlet Side Temperature: 900 to 1050° C., Finish Rolling Exit Side Temperature: 850° C. to 1000° C., and Total Rolling Reduction: 70 to 95%]

The finish rolling is performed in a range satisfying the conditions of a finish rolling inlet side temperature of 900 to 1050° C., a finish rolling exit side temperature of 850° C. to 1000° C., and a total rolling reduction of 70 to 95%. If the finish rolling inlet side temperature falls below 900° C., the finish rolling exit side temperature falls below 850° C., or the total rolling reduction exceeds 95%, the hot rolled steel sheet develops texture, so sometimes anisotropy appears in the final finished product sheet. On the other hand, if the finish rolling inlet side temperature rises above 1050° C., the finish rolling exit side temperature rises above 1000° C., or the total rolling reduction falls below 70%, the hot rolled steel sheet becomes coarser in crystal grain size sometimes leading to coarsening of the final finished product sheet structure and in turn deterioration of the workability. For example, the finish rolling inlet side temperature may be 950° C. or more. The finish rolling exit side temperature may be 900° C. or more. The total rolling reduction may be 75% or more or 80% or more.

[Coiling Temperature: 450 to 680° C.]

The coiling temperature is 450 to 680° C. If the coiling temperature falls below 450° C., the strength of the hot rolled sheet becomes excessive and sometimes the cold rolling ductility is impaired. On the other hand, if the coiling temperature exceeds 680° C., the cementite coarsens and undissolved cementite remains, so sometimes the workability is impaired. The coiling temperature may be 470° C. or more and/or may be 650° C. or less.

In the present method, the obtained hot rolled steel sheet (hot rolled coil) may be pickled or otherwise treated as required. The hot rolled coil may be pickled by any ordinary method. Further, the hot rolled coil may be skin pass rolled to correct its shape and improve its pickling ability.

[Cold Rolling Step]

In this method, after the hot rolling and/or pickling, the steel sheet may be heat treated as is by a continuous hot dip galvanization line or may be cold rolled, then heat treated on a continuous hot dip galvanization line. If performing cold rolling, the cold rolling reduction is preferably 25% or more or 30% or more. On the other hand, since excessive rolling reduction results in an excessive rolling force and leads to increases in load of the cold rolling mill, the upper limit is preferably 75% or 70%.

[(B) Hot Dip Galvanization Step]

[Average Heating Rate from 650° C. to Maximum Heating Temperature of Ac1+30° C. or More and 950° C. or Less: 0.5 to 10.0° C./s]

In this method, after the hot rolling step, the obtained steel sheet is coated in a hot dip galvanization step. In the hot dip galvanization step, first, the steel sheet is heated and subjected to first soaking treatment. At the time of heating the steel sheet, the average heating rate from 650° C. to the maximum heating temperature of Ac1+30° C. or more and 950° C. or less is limited to 0.5 to 10.0° C./s. If the heating rate is more than 10.0° C./s, the recrystallization of ferrite does not sufficiently proceed and sometimes the elongation of the steel sheet becomes poor. On the other hand, if the average heating rate falls below 0.5° C./s, the austenite becomes coarse, so sometimes the finally obtained steel structures become coarse. This average heating rate may be 1.0° C./or more and/or may be 8.0° C./s or less or 5.0° C./s or less. In the present invention, the "average heating rate" means the value obtained by dividing the difference between 650° C. and the maximum heating temperature by the elapsed time from 650° C. to the maximum heating temperature.

[First Soaking Treatment: Holding at Maximum Heating Temperature of Ac1+30° C. or More and 950° C. or Less for 1 Second to 1000 Seconds]

To cause sufficient austenite transformation to proceed, the steel sheet is heated to at least Ac1+30° C. or more and held at that temperature (maximum heating temperature) as soaking treatment. However, if excessively raising the heating temperature, not only is deterioration of the toughness due to coarsening of the austenite grain size invited, but also damage to the annealing facilities is led to. For this reason, the upper limit is 950° C., preferably 900° C. If the soaking time is short, austenite transformation does not sufficiently proceed, so the time is at least 1 second or more. Preferably it is 30 seconds or more or 60 seconds or more. On the other hand, if the soaking time is too long, the productivity is damaged, so the upper limit is 1000 seconds, preferably 500 seconds. During soaking, the steel sheet does not necessarily have to be held at a constant temperature. It may also fluctuate within a range satisfying the above conditions. The "holding" in the first soaking treatment and the later explained second soaking treatment and third soaking treatment means maintaining the temperature within a range of a predetermined temperature±20° C., preferably ±10° C., in a range not exceeding the upper limit value and lower limit value prescribed in the soaking treatments. Therefore, for example, a heating or cooling operation which gradually heats or gradually cools whereby the temperature fluctuates by more than 40° C., preferably 20° C., with the temperature ranges prescribed in the soaking treatments are not included in the first, second, and third soaking treatments according to the embodiment of the present invention.

[First Cooling: Average Cooling Rate in Temperature Range of 700 to 600° C.: 10 to 100° C./s]

After holding at the maximum heating temperature, the steel sheet is cooled by the first cooling. The cooling stop temperature is 480° C. to 600° C. of the following second soaking temperature. The average cooling rate in a temperature range of 700° C. to 600° C. is 10 to 100° C./s. If the average cooling rate is less than 10° C./s, sometimes the desired ferrite fraction cannot be obtained. The average cooling rate may be 15° C./s or more or 20° C./s or more. Further, the average cooling rate may also be 80° C./s or less or 60° C./s or less. In the present invention, "the average cooling rate" means the value obtained by dividing the temperature difference between 700° C. and 600° C., i.e., 100° C., by the elapsed time from 700° C. to 600° C.

[Second Soaking Treatment: Holding in Range of 480° C. to 600° C. for 80 to 500 Seconds]

Second soaking treatment holding the steel sheet in range of 480° C. to 600° C. for 80 to 500 seconds is performed by making Mn segregate at the interfaces of the different phases comprised of austenite and ferrite and bainite. The austenite at that time later becomes tempered martensite. That is, due to the second soaking treatment, Mn segregates at the interfaces of the different phases comprised of austenite and ferrite and bainite and due to the later second cooling and third soaking treatment, the austenite is transformed to martensite and is tempered, whereby as a result the Mn concentration at the interfaces of the different phases comprised of austenite and ferrite and bainite increases. If the temperature of the second soaking treatment falls below 480° C. or becomes higher than 600° or if the holding time falls below 80 seconds, the segregation of the Mn does not sufficiently proceed. On the other hand, if the holding time becomes more than 500 seconds, since bainite transformation will excessively proceed, the metal structures according to the embodiment of the present invention will not be able to be obtained. The temperature of the second soaking treatment may be 500° C. or more and/or may be 570° C. or less. Further, the holding time may be 95 seconds or more and/or may be 460 seconds or less. In relation to this, even if simply suitably performing the second soaking treatment, if not suitably forming the Mn segregated regions in the continuous casting step, the Mn concentration at the interfaces of the different phases decreases. Therefore, in the method for producing the hot dip galvanized steel sheet according to an embodiment of the present invention, to make the Mn concentration at the interface of the different phases increase, it is important to satisfy the conditions of (A1) and (A2) explained above in the continuous casting step while suitably performing the second soaking treatment in the hot dip galvanization step.

In the present method, to produce the hot dip galvanized steel sheet according to an embodiment of the present invention, after the second soaking treatment, predetermined coating treatment has to be performed, but if the second soaking treatment were performed after dipping in the coating bath, sometimes the powdering resistance of the coated layer would remarkably deteriorate. This is because if performing heat treatment after dipping in a coating bath at 480° C. or more for 80 seconds or more, the alloying reaction between the coating and steel sheet excessively proceeds and the structure inside the coating film changes from the δ phases excellent in ductility to the Γ phases poor in ductility.

After the second soaking treatment, the steel sheet is dipped in a hot dip galvanizing bath. The steel sheet temperature at this time has little effect on the performance of the steel sheet, but if the difference between the steel sheet temperature and the coating bath temperature is too large, since the coating bath temperature will change and sometimes hinder operation, provision of a step for cooling the steel sheet to a range of the coating bath temperature−20° C. to the coating bath temperature+20° C. is desirable. The hot dip galvanization may be performed by an ordinary method. For example, the coating bath temperature may be 440 to 460° C. and the dipping time may be 5 seconds or less. The coating bath is preferably a coating bath containing Al in 0.08 to 0.2%, but as impurities, Fe, Si, Mg, Mn, Cr, Ti, and Pb may also be contained. Further, controlling the basis weight of the coating by gas wiping or another known method is preferable. The basis weight is preferably 25 to 75 $g/m^2$ per side.

[Alloying Treatment]

For example, the hot dip galvanized steel sheet formed with the hot dip galvanized layer may be treated to alloy it as required. In this case, if the alloying treatment temperature is less than 460° C., not only does the alloying rate becomes slower and is the productivity hindered, but also uneven alloying treatment occurs, so the alloying treatment temperature is 460° C. or more. On the other hand, if the alloying treatment temperature is more than 600° C., sometimes the alloying excessively proceeds and the coating adhesion of the steel sheet deteriorates. Further, sometimes pearlite transformation proceeds and the desired metallic structure cannot be obtained. Therefore, the alloying treatment temperature is 600° C. or less.

[Second Cooling: Cooling to Ms−50° C. or Less]

The steel sheet after the coating treatment or coating and alloying treatment is cooled by the second cooling which cools it down to the martensite transformation start temperature (Ms)−50° C. or less so as to make part or the majority of the austenite transform to martensite. The martensite produced here is tempered by the subsequent reheating and third soaking treatment to become tempered martensite. If the cooling stop temperature is more than Ms−50° C., since the martensite transformation is insufficient and as a result the tempered martensite is not sufficiently formed, the desired metallic structure is not obtained. If desiring to utilize the retained austenite for improving the ductility of the steel sheet, it is desirable to provide a lower limit to the cooling stop temperature. Specifically, the cooling stop temperature is desirably controlled to a range of Ms−50° C. to Ms−130° C.

Figure 2:
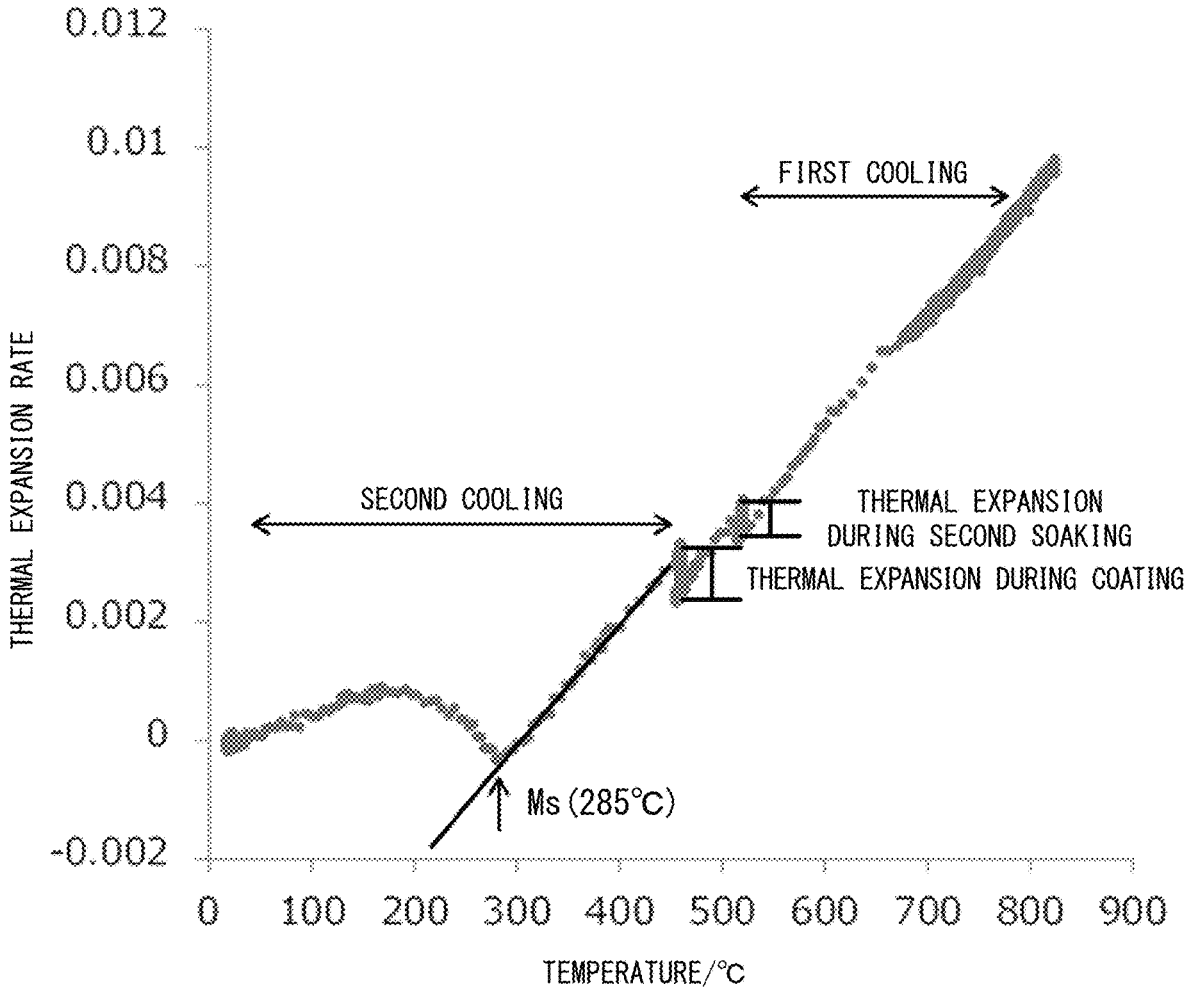
FIG. 2 is a temperature-thermal expansion curve when simulating a heat cycle corresponding to hot dip galvanization treatment according to the embodiment of the present invention by a thermal expansion measurement apparatus.

The martensite transformation in the present invention occurs after the ferrite transformation and bainite transformation. Along with the ferrite transformation and bainite transformation, C is diffused in the austenite. For this reason, this does not match the Ms when heating to the austenite single phase and rapidly cooling. The Ms in the present invention is found by measuring the thermal expansion temperature in the second cooling. For example, the Ms in the present invention can be found by using a Formastor tester or other apparatus able to measure the amount of thermal expansion during continuous heat treatment, reproducing the heat cycle of the hot dip galvanization line from the start of hot dip galvanization heat treatment (corresponding to room temperature) to the above second cooling, and measuring the thermal expansion temperature at that second cooling. However, in actual hot dip galvanization heat treatment, sometimes cooling is stopped between Ms to room temperature, but at the time of measurement of thermal expansion, cooling is performed down to room temperature. FIG. 2 is a temperature-thermal expansion curve simulating by a thermal expansion measurement device a heat cycle corresponding to the hot dip galvanization treatment according to an embodiment of the present invention. Steel sheet linearly thermally contracts in the second cooling step, but departs from a linear relationship at a certain temperature. The temperature at this time is the Ms in the present invention.

[Third Soaking Treatment: Holding in Temperature Region of 200° C. to 420° C. for 5 to 500 Seconds]

After the second cooling, the steel sheet is reheated to a range of 200° C. to 420° C. for the third soaking treatment. In this step, the martensite produced at the time of the second cooling is tempered. If the holding temperature is less than 200° C. or the holding time is less than 5 seconds, the tempering does not sufficiently proceed. On the other hand, if the holding temperature is more than 420° C. or if the holding time is more than 500 seconds, since the martensite is excessively tempered and bainite transformation excessively proceeds, it becomes difficult to obtain the desired strength and metallic structure. The temperature of the third soaking treatment may be 240° C. or more and may be 400° C. or less. Further, the holding time may be 15 seconds or more or may be 100 seconds or more and may be 400 seconds or less.

After the third soaking treatment, the steel sheet is cooled down to room temperature to obtain the final finished product. The steel sheet may also be skin pass rolled to correct the flatness and adjust the surface roughness. In this case, to avoid deterioration of the ductility, the elongation rate is preferably 2% or less.

EXAMPLES

Next, examples of the present invention will be explained. The conditions in the examples are illustrations of conditions employed for confirming the workability and effects of the present invention. The present invention is not limited to these illustrations of conditions. The present invention can employ various conditions so long as not deviating from the gist of the present invention and achieving the object of the present invention.

Example A

Steels having the chemical compositions shown in Table 1 were cast to prepare slabs. The balance other than the constituents shown in Table 1 comprised Fe and impurities. These slabs were hot rolled under the conditions shown in Table 2 to produce hot rolled steel sheets. After that, the hot rolled steel sheets were pickled to remove the surface scale. After that, they were cold rolled. Further, the obtained steel sheets were continuously hot dip galvanized under the conditions shown in Table 2 and suitably treated for alloying. In the soaking treatments shown in Table 2, the temperatures were held within a range of the temperatures shown in Table 2±10° C. The chemical compositions of the base steel sheets obtained by analyzing samples taken from the produced hot dip galvanized steel sheets were equal with the chemical compositions of the steels shown in Table 1.

TABLE 1

| Steel type | C | Si | Mn | P | S | Al | N | O | Cr | Mo | V | Nb |
|---|---|---|---|---|---|---|---|---|---|---|---|---|
| A | 0.215 | 1.77 | 2.27 | 0.005 | 0.0020 | 0.022 | 0.0029 | 0.0007 | | | | |
| B | 0.219 | 1.03 | 1.47 | 0.007 | 0.0024 | 0.747 | 0.0017 | 0.0015 | 0.67 | | | |
| C | 0.187 | 0.78 | 2.52 | 0.009 | 0.0015 | 1.045 | 0.0026 | 0.0011 | | | | |
| D | 0.140 | 1.94 | 1.84 | 0.009 | 0.0022 | 0.028 | 0.0035 | 0.0004 | | | | |
| E | 0.205 | 1.93 | 2.52 | 0.008 | 0.0014 | 0.043 | 0.0019 | 0.0009 | | 0.15 | | 0.020 |
| F | 0.167 | 1.19 | 3.41 | 0.004 | 0.0007 | 0.275 | 0.0030 | 0.0006 | | | | |
| G | 0.202 | 1.49 | 2.66 | 0.009 | 0.0011 | 0.008 | 0.0029 | 0.0010 | | | | |
| H | 0.331 | 1.81 | 2.22 | 0.013 | 0.0021 | 0.045 | 0.0027 | 0.0007 | 0.41 | 0.28 | | |
| I | 0.275 | 1.97 | 3.28 | 0.018 | 0.0014 | 0.016 | 0.0041 | 0.0010 | | | | |
| J | 0.342 | 1.34 | 2.47 | 0.011 | 0.0008 | 0.490 | 0.0028 | 0.0012 | | 0.38 | | |
| K | 0.090 | 1.07 | 2.20 | 0.009 | 0.0024 | 0.029 | 0.0037 | 0.0012 | | 0.04 | | |
| L | 0.082 | 0.45 | 2.29 | 0.016 | 0.0021 | 0.053 | 0.0029 | 0.0011 | 0.29 | 0.07 | | 0.010 |
| M | 0.111 | 0.77 | 2.47 | 0.014 | 0.0019 | 0.040 | 0.0041 | 0.0016 | | | 0.21 | 0.048 |
| N | 0.100 | 0.49 | 2.51 | 0.010 | 0.0009 | 0.007 | 0.0019 | 0.0008 | 0.53 | 0.11 | | |
| O | 0.156 | 0.21 | 2.85 | 0.007 | 0.0011 | 0.033 | 0.0028 | 0.0006 | | | | |
| P | 0.235 | 0.25 | 2.30 | 0.005 | 0.0019 | 0.040 | 0.0021 | 0.0011 | | 0.23 | | |
| Q | 0.226 | 1.07 | 2.53 | 0.006 | 0.0019 | 0.052 | 0.0036 | 0.0021 | 0.40 | | | 0.013 |
| R | **0.041** | 1.60 | 2.68 | 0.019 | 0.0022 | 0.043 | 0.0028 | 0.0007 | | | | |
| S | 0.186 | 1.67 | **0.57** | 0.014 | 0.0007 | 0.052 | 0.0032 | 0.0013 | 0.54 | | | |
| T | 0.147 | 1.12 | **4.45** | 0.009 | 0.0024 | 0.050 | 0.0016 | 0.0019 | | | | |
| U | 0.175 | **2.66** | 2.63 | 0.008 | 0.0015 | 0.033 | 0.0015 | 0.0020 | | | | |
| V | **0.379** | 1.70 | 2.22 | 0.011 | 0.0005 | 0.048 | 0.0031 | 0.0017 | | | | |
| W | 0.227 | 0.60 | 3.17 | 0.016 | 0.0024 | **1.859** | 0.0030 | 0.0019 | | | | |

| Steel type | Ti | B | Cu | Ni | Co | W | Sn | Sb | Others | Ac1 |
|---|---|---|---|---|---|---|---|---|---|---|
| A | | | | | | | | | | 750 |
| B | 0.017 | 0.0020 | | | | | | | Bi: 0.0065 | 748 |
| C | | | | | | | | | | 719 |
| D | | | | | | | | | | 760 |
| E | 0.027 | 0.0010 | | | | | | | Ca: 0.0043 | 752 |
| F | | | 0.24 | 0.17 | | | | | | 718 |
| G | | 0.0008 | | | | | 0.10 | 0.08 | | 738 |
| H | | | | | | | | | | 759 |
| I | 0.024 | 0.0021 | | | | | | | Hf: 0.0037, La: 0.0050 | 745 |
| J | | | | | 0.39 | | | | | 736 |
| K | 0.030 | 0.0012 | | | | | | | | 731 |
| L | | | | | | | | | Mg: 0.0044 | 716 |
| M | 0.040 | 0.0010 | | | | | | | Ce: 0.0052, REM: 0.010 | 719 |
| N | 0.010 | 0.0028 | | | | | | | Zr:0.0079 | 720 |
| O | | | | | | | | | | 699 |
| P | 0.021 | 0.0028 | | | | 0.17 | | | | 706 |
| Q | 0.026 | 0.0022 | 0.16 | | | | | | | 734 |
| R | | | | | | | | | | 741 |
| S | | | | | | | | | | 775 |
| T | | | | | | | | | | 708 |
| U | | | | | | | | | | 772 |
| V | | | | | | | | | | 749 |
| W | | | | | | | | | | 707 |

Bold underlines show outside ranges of present invention.

Empty fields in table show corresponding constituents not intentionally added.

TABLE 2

| | | Continuous casting step | | Hot rolling step | | | | | | Cold rolling |
|---|---|---|---|---|---|---|---|---|---|---|
| | | | | | Rough rolling | Finish | Finish | | | |
| No. | Steel type | Slab surface temp, at time of end of secondary cooling ° C. | Casting rate m/min | Slab heating temp. ° C. | total rolling reduction at 1050° C. or more % | inlet side temp. ° C. | exit side temp. ° C. | Finish rolling total rolling reduction % | Coiling temp. ° C. | step Cold rolling reduction % |
| 1 | A | 980 | 1.4 | 1250 | 85 | 980 | 890 | 91 | 610 | 53 |
| 2 | A | 940 | 1.1 | 1250 | 85 | 1010 | 910 | 91 | 560 | 53 |
| 3 | A | 890 | 1.3 | 1250 | 85 | 1030 | 950 | 91 | 580 | 53 |

TABLE 2-continued

| | | | | | | | | | | |
|---|---|---|---|---|---|---|---|---|---|---|
| 4 | A | **400** | 1.6 | 1240 | 85 | 1010 | 930 | 91 | 580 | 53 |
| 5 | A | 940 | **0.1** | 1240 | 85 | 1010 | 920 | 91 | 560 | 53 |
| 6 | A | 900 | 1.3 | 1260 | 85 | 1030 | 930 | 91 | 530 | 53 |
| 7 | A | 990 | 1.3 | 1240 | 85 | 990 | 900 | 91 | 550 | 53 |
| 8 | A | 960 | 1.5 | 1270 | 85 | 1010 | 910 | 91 | 580 | 53 |
| 9 | A | 940 | 1.6 | 1240 | 85 | 1010 | 910 | 91 | 570 | 53 |
| 10 | B | 1030 | 1.1 | 1240 | 85 | 970 | 880 | 91 | 550 | 53 |
| 11 | B | 890 | 0.9 | 1270 | 85 | 1040 | 950 | 91 | 550 | 53 |
| 12 | B | 1000 | 1.1 | 1250 | 85 | 980 | 890 | 91 | 570 | 53 |
| 13 | B | 1000 | 1.5 | 1210 | 85 | 1020 | 940 | 91 | 560 | 53 |
| 14 | B | 960 | **3.6** | 1220 | 85 | 1030 | 940 | 91 | 560 | 53 |
| 15 | B | 970 | 0.9 | 1240 | 85 | 1010 | 930 | 91 | 570 | 53 |
| 16 | C | 1030 | 1.1 | 1280 | 85 | 1010 | 920 | 91 | 510 | 53 |
| 17 | C | 930 | 1.6 | 1250 | 85 | 1020 | 920 | 91 | 540 | 53 |
| 18 | C | 850 | 1.5 | 1270 | 85 | 1000 | 920 | 91 | 520 | 53 |
| 19 | D | 960 | 1.1 | 1210 | 85 | 1020 | 940 | 91 | 590 | 53 |
| 20 | D | 1010 | 0.9 | 1250 | 85 | 1000 | 910 | 91 | 580 | 53 |
| 21 | D | 900 | 1.3 | 1210 | 85 | 1010 | 930 | 91 | 560 | 53 |
| 22 | E | 970 | 1.5 | 1210 | 85 | 1010 | 910 | 91 | 510 | 53 |
| 23 | E | **1180** | 1.2 | 1230 | 85 | 1000 | 920 | 91 | 570 | 53 |
| 24 | E | 1010 | 1.4 | 1280 | 85 | 1050 | 970 | 91 | 540 | 53 |
| 25 | E | 990 | 1.6 | 1260 | 85 | 1000 | 910 | 91 | 490 | 53 |
| 26 | E | 950 | 1.0 | 1250 | 85 | 1040 | 940 | 91 | 550 | 53 |
| 27 | E | 920 | 1.0 | 1270 | 85 | 1030 | 940 | 91 | 520 | 53 |
| 28 | E | 950 | 0.8 | 1240 | 85 | 970 | 890 | 91 | 530 | 53 |
| 29 | E | 910 | 0.8 | 1240 | 85 | 1010 | 930 | 91 | 520 | 53 |
| 30 | F | 910 | 1.4 | 1190 | 85 | 1050 | 970 | 91 | 510 | 53 |
| 31 | F | 1020 | 0.6 | 1240 | 85 | 1050 | 960 | 91 | 580 | 53 |
| 32 | F | 970 | 1.5 | 1230 | 85 | 1010 | 910 | 91 | 560 | 53 |
| 33 | G | 980 | 1.3 | 1260 | 85 | 1020 | 940 | 91 | 610 | 53 |
| 34 | G | 1030 | 1.5 | 1260 | 85 | 1010 | 920 | 91 | 520 | 53 |
| 35 | H | 970 | 1.5 | 1270 | 85 | 1020 | 920 | 91 | 620 | 53 |
| 36 | H | 970 | 1.6 | 1260 | 85 | 1020 | 920 | 91 | 600 | 53 |
| 37 | I | 970 | 0.9 | 1220 | 85 | 1020 | 920 | 91 | 600 | 53 |
| 38 | I | 900 | 1.6 | 1260 | 85 | 1010 | 910 | 91 | 580 | 53 |
| 39 | J | 970 | 1.6 | 1230 | 85 | 1050 | 960 | 91 | 580 | 53 |
| 40 | J | 940 | 1.3 | 1230 | 85 | 1040 | 960 | 91 | 550 | 53 |
| 41 | K | 890 | 1.1 | 1260 | 85 | 980 | 900 | 91 | 550 | 53 |
| 42 | K | 950 | 1.6 | 1260 | 85 | 980 | 880 | 91 | 580 | 53 |
| 43 | L | 880 | 1.5 | 1260 | 85 | 1050 | 950 | 91 | 470 | 53 |
| 44 | L | 920 | 1.3 | 1250 | 85 | 1030 | 930 | 91 | 470 | 53 |
| 45 | M | 980 | 0.9 | 1260 | 85 | 1010 | 910 | 91 | 490 | 53 |
| 46 | M | 1010 | 0.9 | 1260 | 85 | 1020 | 920 | 91 | 490 | 53 |
| 47 | N | 1010 | 1.4 | 1220 | 85 | 1020 | 930 | 91 | 600 | 53 |
| 48 | N | 1030 | 0.8 | 1230 | 85 | 1020 | 930 | 91 | 620 | 53 |
| 49 | O | 940 | 1.0 | 1240 | 85 | 1000 | 920 | 91 | 580 | 53 |
| 50 | O | 940 | 1.2 | 1240 | 85 | 1000 | 920 | 91 | 550 | 53 |
| 51 | P | 1010 | 1.0 | 1220 | 85 | 1040 | 950 | 91 | 500 | 53 |
| 52 | P | 880 | 1.0 | 1210 | 85 | 1020 | 930 | 91 | 520 | 53 |
| 53 | Q | 910 | 0.9 | 1200 | 85 | 1000 | 920 | 91 | 620 | 53 |
| 54 | Q | 850 | 1.0 | 1210 | 85 | 1010 | 920 | 91 | 640 | 53 |
| 55 | R | 860 | 1.5 | 1250 | 85 | 1010 | 920 | 91 | 540 | 53 |
| 56 | S | 960 | 0.9 | 1240 | 85 | 1010 | 910 | 91 | 620 | 53 |
| 57 | T | 1020 | 1.5 | 1280 | 85 | 1040 | 940 | 91 | 610 | 53 |
| 58 | U | 930 | 1.0 | 1250 | 85 | 970 | 880 | 91 | 560 | 53 |
| 59 | V | 910 | 1.6 | 1250 | 85 | 1000 | 920 | 91 | 520 | 53 |
| 60 | W | 1010 | 0.9 | 1230 | 85 | 1020 | 940 | 91 | 530 | 53 |

| | Hot dip galvanizing step | | | | | | | | | | |
|---|---|---|---|---|---|---|---|---|---|---|---|
| | Heating | | | | | | | | | | |
| | Heating rate from 650° C. | First soaking | | First cooling | Second soaking | | Alloying | Second cooling | Third soaking | | Ms at hot dip |
| No. | to max. heating temp. ° C./s | Temp. ° C. | Holding time s | Cooling rate ° C./s | Temp. ° C. | Holding time s | Alloying temp. ° C. | Cooling stop temp. ° C. | Temp. ° C. | Holding time s | galvanizing step ° C. |
| 1 | 1.9 | 820 | 110 | 30 | 500 | 95 | 490 | 180 | 400 | 300 | 322 |
| 2 | 2.4 | 810 | 110 | 57 | 580 | 95 | 480 | 180 | 390 | 300 | 318 |
| 3 | 1.2 | 820 | 110 | 37 | **350** | 95 | 480 | 100 | 390 | 300 | 221 |
| 4 | 1.4 | 820 | 110 | 38 | 510 | 95 | 480 | 180 | 380 | 300 | 322 |
| 5 | 1.6 | 820 | 110 | 40 | 500 | 95 | 490 | 180 | 380 | 300 | 324 |
| 6 | 1.9 | 820 | 110 | 38 | 500 | 460 | 480 | 120 | 380 | 300 | 259 |
| 7 | 1.8 | 820 | 110 | 45 | 520 | 95 | 480 | **270** | 380 | 300 | 254 |
| 8 | 1.5 | 820 | 110 | 44 | 500 | 95 | 480 | 150 | **180** | 300 | 286 |
| 9 | 1.4 | 820 | 110 | 49 | 500 | 95 | — | 160 | 400 | 300 | 322 |
| 10 | 1.4 | 880 | 110 | 34 | 540 | 95 | 480 | 230 | 380 | 300 | 373 |
| 11 | 2.9 | 930 | 110 | 70 | 550 | 95 | 490 | 250 | 400 | 300 | 408 |
| 12 | 2.2 | **750** | 110 | 22 | 550 | 95 | 490 | **100** | 390 | 300 | <50 |

TABLE 2-continued

| | | | | | | | | | | | |
|---|---|---|---|---|---|---|---|---|---|---|---|
| 13 | 2.3 | 860 | 110 | **2** | 550 | 95 | 480 | 150 | 400 | 300 | 242 |
| 14 | 1.9 | 870 | 110 | 51 | 540 | 95 | 490 | 220 | 400 | 300 | 389 |
| 15 | 1.9 | 860 | 110 | 40 | 550 | 95 | — | 230 | 380 | 300 | 350 |
| 16 | 1.8 | 890 | 110 | 31 | 560 | 95 | 500 | 200 | 380 | 300 | 331 |
| 17 | 2.2 | 890 | 110 | 33 | 490 | **790** | 460 | **80** | 400 | 300 | <50 |
| 18 | 2.2 | 890 | 110 | 37 | 500 | 95 | — | 260 | 380 | 300 | 316 |
| 19 | 1.9 | 890 | 110 | 33 | 530 | 95 | 480 | 200 | 350 | 300 | 345 |
| 20 | 1.7 | 880 | 110 | 34 | 530 | 95 | 480 | 210 | 360 | 100 | 342 |
| 21 | 1.8 | 880 | 110 | 32 | **640** | 95 | 480 | 150 | 350 | 300 | 239 |
| 22 | 1.4 | 860 | 110 | 36 | 550 | 95 | 520 | 220 | 390 | 300 | 358 |
| 23 | 1.9 | 870 | 110 | 42 | 550 | 95 | 510 | 230 | 390 | 300 | 345 |
| 24 | 1.7 | 900 | 110 | 39 | 550 | 95 | 540 | 230 | 400 | 300 | 374 |
| 25 | 1.6 | 850 | 110 | 30 | 550 | 95 | 500 | 210 | 300 | 300 | 356 |
| 26 | 1.5 | 850 | 110 | 35 | 550 | 95 | 550 | **350** | 400 | 300 | 342 |
| 27 | 1.6 | 880 | 110 | 39 | 550 | **60** | 510 | 230 | 400 | 300 | 366 |
| 28 | 1.4 | 870 | 110 | 57 | 550 | 95 | 500 | 230 | 390 | **3** | 327 |
| 29 | 2.0 | 860 | 110 | 41 | 560 | 95 | — | 190 | 400 | 300 | 361 |
| 30 | 2.2 | 850 | 110 | 36 | 540 | 95 | 500 | 230 | 400 | 300 | 355 |
| 31 | 1.4 | 850 | 110 | 47 | 590 | 95 | 590 | 240 | 400 | 480 | 356 |
| 32 | 2.2 | 850 | 110 | 37 | 550 | 95 | — | 180 | 400 | 300 | 356 |
| 33 | 1.8 | 830 | 110 | 31 | 550 | 95 | 500 | 200 | 400 | 300 | 349 |
| 34 | 1.4 | 830 | 110 | 44 | 550 | 95 | — | 200 | 400 | 300 | 349 |
| 35 | 2.1 | 880 | 110 | 30 | 530 | 95 | 510 | 240 | 400 | 300 | 334 |
| 36 | 1.5 | 880 | 110 | 26 | 530 | 95 | — | 240 | 400 | 300 | 334 |
| 37 | 1.5 | 870 | 110 | 30 | 540 | 95 | 530 | 200 | 350 | 300 | 322 |
| 38 | 2.2 | 870 | 110 | 50 | 540 | 95 | — | 200 | 350 | 300 | 322 |
| 39 | 1.2 | 870 | 110 | 43 | 550 | 95 | 520 | 200 | 370 | 300 | 333 |
| 40 | 2.1 | 870 | 110 | 39 | 550 | 95 | — | 200 | 380 | 300 | 335 |
| 41 | 1.9 | 820 | 110 | 43 | 550 | 95 | 540 | 60 | 300 | 20 | 409 |
| 42 | 1.9 | 820 | 110 | 37 | 550 | 95 | — | 60 | 300 | 20 | 409 |
| 43 | 1.2 | 820 | 110 | 28 | 540 | 95 | 530 | 90 | 280 | 20 | 407 |
| 44 | 1.8 | 820 | 110 | 24 | 540 | 95 | — | 90 | 280 | 20 | 406 |
| 45 | 2.0 | 820 | 110 | 34 | 550 | 95 | 530 | 70 | 280 | 20 | 397 |
| 46 | 1.9 | 820 | 110 | 27 | 550 | 95 | — | 70 | 280 | 20 | 398 |
| 47 | 1.2 | 810 | 110 | 36 | 550 | 95 | 540 | 50 | 300 | 20 | 395 |
| 48 | 1.6 | 810 | 110 | 41 | 550 | 95 | — | 50 | 300 | 20 | 395 |
| 49 | 1.7 | 810 | 110 | 38 | 540 | 95 | 500 | 50 | 300 | 20 | 363 |
| 50 | 1.7 | 810 | 110 | 46 | 560 | 95 | — | 50 | 300 | 20 | 365 |
| 51 | 1.8 | 850 | 110 | 34 | 560 | 95 | 510 | 120 | 280 | 20 | 375 |
| 52 | 2.2 | 850 | 110 | 37 | 560 | 95 | — | 120 | 280 | 20 | 375 |
| 53 | 1.9 | 860 | 110 | 29 | 550 | 95 | 530 | 100 | 290 | 20 | 361 |
| 54 | 1.7 | 860 | 110 | 25 | 550 | 95 | — | 100 | 290 | 20 | 361 |
| 55 | 2.0 | 880 | 110 | 35 | 540 | 95 | 510 | 250 | 390 | 330 | 417 |
| 56 | 1.5 | 880 | 110 | 43 | 550 | 95 | 500 | 100 | 400 | 330 | <50 |
| 57 | 2.0 | 810 | 110 | 50 | 550 | 95 | 530 | 180 | 380 | 330 | 316 |
| 58 | 1.1 | 900 | 110 | 25 | 540 | 95 | 580 | 250 | 370 | 330 | 372 |
| 59 | 1.7 | 850 | 110 | 28 | 550 | 95 | 520 | 200 | 390 | 330 | 321 |
| 60 | 2.4 | 900 | 110 | 37 | 550 | 95 | 520 | 150 | 400 | 330 | 223 |

Bold underlines show outside ranges of present invention.

A JIS No. 5 tensile test piece was taken from each of the thus obtained steel sheets in a direction perpendicular to the rolling direction and was subjected to a tensile test based on JIS Z2241: 2011 to measure the tensile strength (TS) and total elongation (El). Further, each test piece was tested by the "JFS T 1001 Hole Expansion Test Method" of the Japan Iron and Steel Federation Standards to measure the hole expansion rate (λ). A test piece with a TS of 980 MPa or more and a $TS \times El \times \lambda^{0.5}/1000$ of 80 or more was judged good in mechanical properties and as having press formability preferable for use as a member for automobiles.

The low temperature toughness was evaluated by a Charpy test. A Charpy test piece was obtained by stacking a plurality of steel sheets and bolting them together, confirming there was no clearance between the steel sheets, then fabricating a depth 2 mm V-notched test piece. The number of stacked steel sheets was set so that the thickness of the test piece after stacking became the closest to 10 mm. For example, if the thickness is 1.2 mm, eight are stacked to give a thickness of the test piece of 9.6 mm. The stacked Charpy test piece was obtained using the sheet width direction as the long direction. A low temperature toughness when the test temperature was −50° C. and +20° C. and the impact absorption energy ratio $vE_{-50}/vE_{20}$ at −50° C. and +20° C. was 0.6 or more was judged to be excellent (in Table 3, "very good"). The conditions other than the above were based on JIS Z 2242: 2018.

Furthermore, the thus obtained steel sheets were examined for microstructures. The procedures for examination of the microstructures were as explained above.

The results are shown in Table 3. In Table 3, "GA" means hot dip galvannealing, while GI means hot dip galvanizing without alloying treatment. The "number ratio satisfying formulas (1) and (2)" in Table 3 is obtained by following the method of measurement explained previously in this Description to measure in particular 10 different particles of tempered martensite.

TABLE 3

| No. | Steel type | Coating | Microstructure: Ferrite % | Retained austenite % | Tempered martensite % | Fresh martensite % | Pearlite + cementite % | Bainite % | No. density satisfying formulas (1) and (2) |
|---|---|---|---|---|---|---|---|---|---|
| 1 | A | GA | 31 | 13 | 30 | 3 | 0 | 23 | 0.5 |
| 2 | A | GA | 36 | 11 | 34 | 2 | 0 | 17 | 0.7 |
| 3 | A | GA | 30 | 11 | 15 | 2 | 0 | 42 | **0.1** |
| 4 | A | GA | 32 | 12 | 33 | 2 | 0 | 21 | **0.1** |
| 5 | A | GA | 30 | 11 | 37 | 2 | 0 | 20 | **0.1** |
| 6 | A | GA | 33 | 12 | 18 | 1 | 0 | 36 | 0.6 |
| 7 | A | GA | 34 | 9 | **0** | 9 | 0 | 48 | — |
| 8 | A | GA | 33 | 5 | 19 | **20** | 0 | 23 | 0.7 |
| 9 | A | GI | 32 | 12 | 33 | 2 | 0 | 21 | 0.7 |
| 10 | B | GA | 33 | 11 | 36 | 2 | 0 | 18 | 0.8 |
| 11 | B | GA | 8 | 10 | 56 | 2 | 0 | 24 | 0.8 |
| 12 | B | GA | **75** | 6 | **0** | 8 | 0 | 11 | — |
| 13 | B | GA | **66** | 5 | 5 | 5 | **7** | 12 | 0.7 |
| 14 | B | GA | 22 | 10 | 40 | 2 | 0 | 26 | **0.1** |
| 15 | B | GI | 40 | 11 | 21 | 2 | 0 | 26 | 0.8 |
| 16 | C | GA | 47 | 10 | 23 | 3 | 0 | 17 | 0.8 |
| 17 | C | GA | 48 | 11 | **0** | 5 | 0 | 36 | — |
| 18 | C | GI | 45 | 11 | 10 | 5 | 0 | 29 | 0.8 |
| 19 | D | GA | 15 | 7 | 50 | 1 | 0 | 27 | 0.7 |
| 20 | D | GA | 20 | 7 | 49 | 3 | 0 | 21 | 0.7 |
| 21 | D | GA | **66** | 7 | 10 | 2 | **6** | 9 | **0.1** |
| 22 | E | GA | 17 | 11 | 48 | 2 | 0 | 22 | 0.9 |
| 23 | E | GA | 14 | 12 | 45 | 2 | 0 | 27 | **0.1** |
| 24 | E | GA | 0 | 9 | 65 | 1 | 0 | 25 | 0.9 |
| 25 | E | GA | 21 | 5 | 62 | 3 | 0 | 9 | 0.9 |
| 26 | E | GA | 23 | 7 | **0** | **20** | 0 | 50 | — |
| 27 | E | GA | 12 | 12 | 51 | 1 | 0 | 24 | **0.1** |
| 28 | E | GA | 18 | 4 | 36 | **19** | 0 | 23 | 0.7 |
| 29 | E | GI | 18 | 10 | 60 | 2 | 0 | 10 | 0.8 |
| 30 | F | GA | 4 | 8 | 60 | 1 | 0 | 27 | 0.9 |
| 31 | F | GA | 4 | 7 | 64 | 3 | 0 | 22 | 0.7 |
| 32 | F | GI | 4 | 8 | 75 | 1 | 0 | 12 | 0.8 |
| 33 | G | GA | 20 | 12 | 42 | 2 | 0 | 24 | 0.8 |
| 34 | G | GI | 20 | 12 | 42 | 1 | 0 | 25 | 1.0 |
| 35 | H | GA | 0 | 24 | 60 | 4 | 0 | 12 | 0.5 |
| 36 | H | GI | 0 | 24 | 60 | 4 | 0 | 12 | 0.6 |
| 37 | I | GA | 0 | 18 | 62 | 3 | 0 | 17 | 0.9 |
| 38 | I | GI | 0 | 18 | 63 | 3 | 0 | 16 | 0.7 |
| 39 | J | GA | 6 | 26 | 54 | 4 | 0 | 10 | 0.8 |
| 40 | J | GI | 5 | 25 | 58 | 3 | 0 | 9 | 0.6 |
| 41 | K | GA | 38 | 2 | 33 | 5 | 0 | 22 | 0.7 |
| 42 | K | GI | 38 | 2 | 35 | 5 | 0 | 20 | 0.7 |
| 43 | L | GA | 30 | 1 | 31 | 3 | 0 | 35 | 0.6 |
| 44 | L | GI | 30 | 1 | 30 | 3 | 0 | 36 | 0.9 |
| 45 | M | GA | 15 | 2 | 53 | 6 | 0 | 24 | 0.8 |
| 46 | M | GI | 15 | 2 | 54 | 6 | 0 | 23 | 0.9 |
| 47 | N | GA | 17 | 0 | 58 | 4 | 0 | 21 | 0.8 |
| 48 | N | GI | 17 | 0 | 59 | 4 | 0 | 20 | 0.8 |
| 49 | O | GA | 22 | 2 | 50 | 2 | 0 | 24 | 0.8 |
| 50 | O | GI | 20 | 2 | 53 | 2 | 0 | 23 | 0.8 |
| 51 | P | GA | 0 | 2 | 84 | 3 | 0 | 11 | 0.8 |
| 52 | P | GI | 0 | 2 | 85 | 3 | 0 | 10 | 0.8 |
| 53 | Q | GA | 0 | 4 | 80 | 6 | 0 | 10 | 0.7 |
| 54 | Q | GI | 0 | 4 | 80 | 6 | 0 | 10 | 0.6 |
| 55 | R | GA | 35 | 2 | 34 | 0 | 0 | 29 | 0.6 |
| 56 | S | GA | **70** | 10 | **0** | 0 | 0 | 20 | — |
| 57 | T | GA | 14 | 3 | 57 | **15** | 0 | 11 | 0.9 |
| 58 | U | GA | 13 | 7 | 45 | **16** | 0 | 19 | 0.8 |
| 59 | V | GA | 0 | **32** | 35 | **11** | 0 | 22 | 0.6 |
| 60 | W | GA | **60** | 10 | 9 | 4 | 0 | 17 | 0.5 |

| No. | Mechanical properties: TS MPa | E1 % | Press formability: λ % | TS*E1*$\lambda^{0.5}$/1000 | vE-50/vE20 | Remarks |
|---|---|---|---|---|---|---|
| 1 | 1028 | 24.5 | 31 | 140 | Very good | Ex. |
| 2 | 1077 | 21.3 | 42 | 149 | Very good | Ex. |
| 3 | 1006 | 22.0 | 39 | 138 | Poor | Comp. ex. |
| 4 | 1003 | 22.4 | 38 | 138 | Poor | Comp. ex. |
| 5 | 1059 | 22.5 | 42 | 153 | Poor | Comp. ex. |

TABLE 3-continued

| | | | | | | |
|---|---|---|---|---|---|---|
| 6 | 988 | 23.6 | 29 | 127 | Very good | Ex. |
| 7 | **949** | 20.3 | 16 | **77** | Very good | Comp. ex. |
| 8 | 1126 | 17.1 | 15 | **74** | Poor | Comp. ex. |
| 9 | 1022 | 24.0 | 33 | 141 | Very good | Ex. |
| 10 | 1044 | 21.7 | 35 | 134 | Very good | Ex. |
| 11 | 1120 | 17.2 | 58 | 147 | Very good | Ex |
| 12 | **803** | 23.1 | 30 | 101 | Very good | Comp. ex. |
| 13 | **913** | 19.2 | 19 | **76** | Very good | Comp. ex. |
| 14 | 1057 | 20.6 | 33 | 125 | Poor | Comp. ex. |
| 15 | 1029 | 23.7 | 28 | 129 | Very good | Ex. |
| 16 | 1004 | 22.8 | 18 | 97 | Very good | Ex. |
| 17 | **918** | 20.7 | 20 | 86 | Very good | Comp. ex. |
| 18 | 988 | 23.9 | 16 | 94 | Very good | Ex. |
| 19 | 1067 | 17.7 | 51 | 135 | Very good | Ex. |
| 20 | 1103 | 19.0 | 44 | 139 | Very good | Ex. |
| 21 | **922** | 18.6 | 20 | **77** | Poor | Comp. ex. |
| 22 | 1207 | 17.1 | 48 | 143 | Very good | Ex. |
| 23 | 1234 | 16.5 | 51 | 145 | Poor | Comp. ex. |
| 24 | 1279 | 14.4 | 62 | 145 | Very good | Ex. |
| 25 | 1314 | 13.5 | 38 | 109 | Very good | Ex. |
| 26 | 1256 | 13.9 | 19 | **77** | Poor | Comp. ex. |
| 27 | 1254 | 16.5 | 40 | 131 | Poor | Comp. ex. |
| 28 | 1377 | 12.2 | 15 | **65** | Poor | Comp. ex. |
| 29 | 1201 | 17.6 | 44 | 140 | Very good | Ex. |
| 30 | 1215 | 14.5 | 51 | 126 | Very good | Ex. |
| 31 | 1228 | 14.3 | 40 | 111 | Very good | Ex. |
| 32 | 1267 | 13.1 | 55 | 123 | Very good | Ex. |
| 33 | 1203 | 18.2 | 41 | 139 | Very good | Ex. |
| 34 | 1195 | 16.7 | 42 | 129 | Very good | Ex. |
| 35 | 1479 | 17.7 | 24 | 128 | Very good | Ex. |
| 36 | 1486 | 18.0 | 27 | 139 | Very good | Ex. |
| 37 | 1478 | 15.4 | 31 | 127 | Very good | Ex. |
| 38 | 1461 | 15.0 | 33 | 126 | Very good | Ex. |
| 39 | 1567 | 17.2 | 30 | 149 | Very good | Ex. |
| 40 | 1554 | 16.2 | 30 | 138 | Very good | Ex. |
| 41 | 1012 | 13.6 | 51 | 98 | Very good | Ex. |
| 42 | 1019 | 13.7 | 50 | 98 | Very good | Ex. |
| 43 | 1004 | 14.0 | 50 | 99 | Very good | Ex. |
| 44 | 992 | 14.2 | 48 | 98 | Very good | Ex. |
| 45 | 1260 | 11.0 | 49 | 97 | Very good | Ex. |
| 46 | 1246 | 11.2 | 46 | 95 | Very good | Ex. |
| 47 | 1223 | 10.9 | 52 | 96 | Very good | Ex. |
| 48 | 1241 | 10.8 | 53 | 98 | Very good | Ex. |
| 49 | 1223 | 11.2 | 36 | 82 | Very good | Ex. |
| 50 | 1232 | 10.6 | 38 | 81 | Very good | Ex. |
| 51 | 1547 | 8.1 | 47 | 86 | Very good | Ex. |
| 52 | 1552 | 8.0 | 50 | 88 | Very good | Ex. |
| 53 | 1536 | 9.0 | 44 | 91 | Very good | Ex. |
| 54 | 1545 | 9.1 | 46 | 95 | Very good | Ex. |
| 55 | **824** | 24.9 | 59 | 158 | Very good | Comp. ex. |
| 56 | **757** | 25.6 | 40 | 123 | Very good | Comp. ex. |
| 57 | 1412 | 10.0 | 10 | 45 | Poor | Comp. ex. |
| 58 | 1367 | 10.3 | 11 | 47 | Poor | Comp. ex. |
| 59 | 1382 | 23.1 | 13 | 113 | Poor | Comp. ex. |
| 60 | **940** | 26.2 | 21 | 114 | Very good | Como. ex. |

Bold underlines show outside ranges of present invention.

Comparative Examples 3 and 21 had temperatures of the second soaking treatment in the hot dip galvanizing step of respectively less than 480° C. and more than 600° C. As a result, the ratios of tempered martensite satisfying the formulas (1) and (2) became less than 0.2 and the low temperature toughnesses were poor. Comparative Examples 4 and 23 had surface slab temperatures at the time of the end of the secondary cooling of the continuous casting step of respectively less than 500° C. and more than 1100° C. As a result, the ratios of tempered martensite satisfying the formulas (1) and (2) became less than 0.2 and the low temperature toughnesses were poor. Comparative Examples 5 and 14 had casting rates in the continuous casting step of respectively less than 0.4 m/min and more than 3.0 m/min. As a result, the ratios of tempered martensite satisfying the formulas (1) and (2) became less than 0.2 and the low temperature toughnesses were poor. Comparative Example 7, 12, 17, and 26 had stop temperatures of the second cooling in the hot dip galvanizing step of more than Ms−50° C. and a tempered martensite not satisfying 5%. Further, Comparative Example 26 had a fresh martensite of more than 10%. As a result, Comparative Examples 7, 12, and 17 had tensile strengths of less than 980 MPa. Comparative Example 26 contained hard fresh martensite in large amounts, so while the tensile strength was secured, the press formability and low temperature toughness became poor. Comparative Example 8 had a temperature of the third soaking treatment in the hot dip galvanizing step was less than 200° C. As a result, the fresh martensite became more than 10% and the press formability and low temperature toughness were poor.

Comparative Example 13 had an average cooling rate of the first cooling in the hot dip galvanizing step of less than 10° C./s. As a result, the ferrite became more than 50%, the total of the pearlite and cementite became more than 5%, and the press formability was poor. Comparative Example 27 had a holding time of the second soaking treatment in the hot dip galvanizing step of less than 80 seconds. As a result, the ratio of the tempered martensite satisfying the formulas (1) and (2) became less than 0.2 and the low temperature toughness was poor. Comparative Example 28 had a holding time of the third soaking treatment in the hot dip galvanizing step of less than 5 seconds. As a result, the fresh martensite became more than 10% and the press formability and low temperature toughness were poor. Comparative Examples 55 to 60 had chemical compositions of not controlled to within predetermined ranges, so the desired metallic structure was not obtained and the press formability and/or low temperature toughness were poor.

In contrast to this, the hot dip galvanized steel sheets of the examples have a tensile strength of 980 MPa or more and $TS \times El \times \lambda^{0.5}/1000$ of 80 or more and further have a $vE_{-50}/vE_{20}$ of 0.6 or more, so it is learned that they are excellent in press formability and low temperature toughness.

Example B

In this example, the inventors studied the presence or absence of a specific soaking treatment. First, they prepared a slab having the chemical composition shown in Table 1, then, as shown in Table 4, made the first cooling gradual cooling to eliminate the second soaking treatment. Other than that, the same procedure was followed as the case of Example A to obtain hot dip galvanized steel sheet. The steel structures and mechanical properties in the obtained hot dip galvanized steel sheet were investigated by methods similar to the case of Example A. The results are shown in Table 5. In the different soaking treatments shown in Table 4, the temperature was maintained within a range of the temperature shown in Table 4±10° C.

TABLE 4

| | | Continuous casting step | | Hot rolling step | | | | | | Cold rolling |
|---|---|---|---|---|---|---|---|---|---|---|
| No. | Steel type | Slab surface temp, at secondary cooling end point ° C. | Casting rate m/min | Slab heating temp. ° C. | Rough rolling total rolling reduction at 1050° C. or more % | Finish inlet side temp. ° C. | Finish exit side temp. ° C. | Finish rolling total rolling reduction % | Coiling temp. ° C. | step Cold rolling reduction % |
| 61 | A | 980 | 1.4 | 1250 | 85 | 980 | 890 | 91 | 610 | 53 |

| | Hot dip galvanizing step | | | | | | | | |
|---|---|---|---|---|---|---|---|---|---|
| | Heating Heating rate from 650° C. | First soaking | | First cooling | | Alloying | Third soaking | | Ms at hot dip |
| No. | to maximum heating temp. ° C./s | Temp. ° C. | Holding time s | Cooling rate ° C./s | Cooling stop temp ° C. | Alloying temp. ° C. | Temp. ° C. | Holding time s | galvanizing step ° C. |
| 61 | 1.9 | 820 | 110 | **1** | 180 | 490 | 400 | 300 | 255 |

Bold underlines show outside ranges of present invention.

TABLE 5

| | | | Microstructure | | | | | | |
|---|---|---|---|---|---|---|---|---|---|
| No. | Steel type | Coating | Ferrite % | Retained austenite % | Tempered martensite % | Fresh martensite % | Pearlite + cementite % | Bainite % | No. density satisfying formulas (1) and (2) |
| 61 | A | GA | **53** | 7 | 12 | 6 | **6** | 16 | **0.1** |

| | Mechanical properties | | | | | |
|---|---|---|---|---|---|---|
| | Press formability | | | | | |
| No. | TS MPa | El % | λ % | $TS*El*\lambda^{0.5}/1000$ | vE-50/vE20 | Remarks |
| 61 | **902** | 18.7 | 20 | **75** | Poor | Comp. ex. |

Bold underlines show outside ranges of present invention.

As clear from the results of Table 5, if making the first cooling gradual cooling to eliminate second soaking treatment, the desired metallic structure cannot be obtained, the ratio of the tempered martensite satisfying the formulas (1) and (2) became less than 2.0, and the press formability and low temperature toughness were poor.

Example C

In this example, the inventors similarly studied the relationship of the soaking treatment and coating treatment. First, they prepared a slab having the chemical composition shown in Table 1, then, as shown in Table 6, performed the same procedure as the case of Example A to obtain hot dip galvanized steel sheet except for performing the coating and alloying treatment not after the second soaking treatment but after the third soaking treatment. The steel structures and mechanical properties in the obtained hot dip galvanized steel sheet were investigated by methods similar to the case of Example A. The results are shown in Table 7. In the different soaking treatments shown in Table 6, the temperature was maintained within a range of the temperature shown in Table 6±10° C.

As clear from the results of Table 7, if performing the coating and alloying treatment after the third soaking treatment, the desired metallic structures cannot be obtained and the press formability and low temperature toughness were poor.

The invention claimed is:

1. A hot dip galvanized steel sheet comprising a base steel sheet and a hot dip galvanized layer on at least one surface of the base steel sheet, wherein the base steel sheet has a chemical composition comprising, by mass %, C: 0.050% to 0.350%,
Si: 0.10% to 2.50%,
Mn: 1.00% to 3.50%,
P: 0.050% or less,
S: 0.0100% or less,
Al: 0.001% to 1.500%,
N: 0.0100% or less,
O: 0.0100% or less,
Ti: 0% to 0.200%,
B: 0% to 0.0100%,
V: 0% to 1.00%,
Nb: 0% to 0.100%,
Cr: 0% to 2.00%,
Ni: 0% to 1.00%,
Cu: 0% to 1.00%,

TABLE 6

| | | Continuous casting step | | Hot rolling step | | | | | | Cold rolling |
|---|---|---|---|---|---|---|---|---|---|---|
| No. | Steel type | Slab surface temp, at secondary cooling end point ° C. | Casting rate m/min | Slab heating temp. ° C. | Rough rolling total rolling reduction at 1050° C. or more % | Finish inlet side temp. ° C. | Finish exit side temp. ° C. | Finish rolling total rolling reduction % | Coiling temp. ° C. | step Cold rolling reduction % |
| 63 | A | 980 | 1.4 | 1250 | 85 | 980 | 890 | 91 | 610 | 53 |

| | Hot dip galvanizing step | | | | | | | | | | |
|---|---|---|---|---|---|---|---|---|---|---|---|
| | Heating Heating rate from 650° C. | First soaking | | First cooling | Second soaking | | Second cooling | Third soaking | | Alloying | Ms at hot dip |
| No. | to maximum heating temp. ° C./s | Temp. ° C. | Holding time s | Cooling rate ° C./s | Temp. ° C. | Holding time s | Cooling stop temp. ° C. | Temp. ° C. | Holding time s | Alloying temp. ° C. | galvanizing step ° C. |
| 63 | 1.9 | 820 | 110 | 30 | 500 | 95 | 180 | 400 | 300 | 500 | 322 |

Bold underlines show outside ranges of present invention.

TABLE 7

| | | | Microstructure | | | | | | |
|---|---|---|---|---|---|---|---|---|---|
| No. | Steel type | Coating | Ferrite % | Retained austenite % | Tempered martensite % | Fresh martensite % | Pearlite + cementite % | Bainite % | No. density satisfying formulas (1) and (2) |
| 63 | A | GA | 32 | 8 | 30 | 6 | **7** | 17 | 0.5 |

| | Mechanical properties | | | | | |
|---|---|---|---|---|---|---|
| | Press formability | | | | | |
| No. | TS MPa | E1 % | λ % | TS*E1*$\lambda^{0.5}$/1000 | vE-50/vE20 | Remarks |
| 63 | **966** | 19.3 | 17 | **77** | Poor | Comp. ex. |

Bold underlines show outside ranges of present invention.

Co: 0% to 1.00%,
Mo: 0% to 1.00%,
W: 0% to 1.00%,
Sn: 0% to 1.00%,
Sb: 0% to 1.00%,
Ca: 0% to 0.0100%,
Mg: 0% to 0.0100%,
Ce: 0% to 0.0100%,
Zr: 0% to 0.0100%,
La: 0% to 0.0100%,
Hf: 0% to 0.0100%,
Bi: 0% to 0.0100%,
REM other than Ce and La: 0% to 0.0100% and
a balance of Fe and impurities, a steel microstructure at a range of ⅛ thickness to ⅜ thickness centered about a position of ¼ thickness from a surface of the base steel sheet contains, by volume fraction, ferrite: 0% to 50%,
retained austenite: 0% to 30%,
tempered martensite: 5% or more,
fresh martensite: 0% to 10%, and
pearlite and cementite in total: 0% to 5%, when there are remaining structures, the remaining structures consist of bainite, and a number ratio of tempered martensite with a Mn concentration profile satisfying the following formulas (1) and (2) is 0.2 or more with respect to the total number of the tempered martensite:

$$[Mn]_b/[Mn]_a>1.2 \quad (1)$$

$$[Mn]_a/[Mn]<2.0 \quad (2)$$

where [Mn] is the Mn content in mass % in the base steel sheet, $[Mn]_a$ is the average Mn concentration in mass % in the tempered martensite, and [Mn]b is the Mn concentration in mass % at the interfaces of different phases of the tempered martensite and at least one of the ferrite phase and the bainite phase.

2. The hot dip galvanized steel sheet according to claim 1, wherein the steel microstructure contains, by volume fraction, retained austenite: 6% to 30%.

3. A method for producing the hot dip galvanized steel sheet according to claim 1, comprising a continuous casting step for continuously casting a slab having the chemical composition according to claim 1, a hot rolling step for hot rolling the cast slab, and a hot dip galvanizing step for hot dip galvanizing the obtained steel sheet, wherein (A) the continuous casting step satisfies the conditions of the following (A1) and (A2):
  (A1) a slab surface temperature at the time of the end of a secondary cooling is 500 to 1100° C. and
  (A2) a casting rate is 0.4 to 3.0 m/s, and (B) the hot dip galvanizing step comprises heating the steel sheet to first soak it, first cooling then second soaking the first soaked steel sheet, dipping the second soaked steel sheet in a hot dip galvanizing bath, second cooling the coated steel sheet, and heating the second cooled steel sheet then third soaking it, and further satisfies the conditions of the following (B1) to (B6):
  (B1) in the heating of the steel sheet before the first soaking, the average heating rate from 650° C. to a maximum heating temperature of Ac1+30° C. or more and 950° C. or less is 0.5° C./s to 10.0° C./s,
  (B2) the steel sheet is held at the maximum heating temperature for 1 second to 1000 seconds (first soaking),
  (B3) an average cooling rate in a temperature range of 700 to 600° C. at the first cooling is 10 to 100° C./s,
  (B4) the first cooled steel sheet is held in a range of 480 to 600° C. for 80 seconds to 500 seconds (second soaking),
  (B5) the second cooling is performed down to Ms−50° C. or less, and
  (B6) the second cooled steel sheet is heated to a temperature region of 200 to 420° C., then held in the temperature region for 5 to 500 seconds (third soaking).

* * * * *